US006762013B2

(12) United States Patent
Sakizadeh et al.

(10) Patent No.: US 6,762,013 B2
(45) Date of Patent: Jul. 13, 2004

(54) THERMALLY DEVELOPABLE MATERIALS CONTAINING FLUOROCHEMICAL CONDUCTIVE LAYERS

(75) Inventors: Kumars Sakizadeh, Woodbury, MN (US); Gary E. LaBelle, Stillwater, MN (US); Aparna V. Bhave, Woodbury, MN (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/265,058

(22) Filed: Oct. 4, 2002

(65) Prior Publication Data

US 2004/0067454 A1 Apr. 8, 2004

(51) Int. Cl.[7] ..... G03C 5/16; G03C 1/498; G03C 1/38

(52) U.S. Cl. ..... 430/350; 430/510; 430/528; 430/619; 430/620; 430/631; 430/965

(58) Field of Search ..... 430/619, 350, 430/510, 528, 620, 631, 965, 945; 503/200

(56) References Cited

U.S. PATENT DOCUMENTS

| | | | | |
|---|---|---|---|---|
| 3,589,906 | A | 6/1971 | McDowell | |
| 3,884,699 | A | 5/1975 | Cavallo et al. | |
| 4,013,696 | A | 3/1977 | Babbitt et al. | |
| 4,266,015 | A | 5/1981 | Butler et al. | |
| 4,420,434 | A | 12/1983 | Falk | |
| 4,474,873 | A | * 10/1984 | Maekawa et al. | 430/528 |
| 4,596,766 | A | 6/1986 | Nemori et al. | |
| 4,975,363 | A | 12/1990 | Cavallo et al. | |
| 5,098,821 | A | 3/1992 | Cavallo et al. | |
| 5,207,996 | A | 5/1993 | Sierakowski et al. | |
| 5,380,644 | A | 1/1995 | Yonkoski et al. | |
| 5,468,603 | A | 11/1995 | Kub | |
| 5,532,121 | A | 7/1996 | Yonkoski et al. | |
| 5,547,821 | A | 8/1996 | Melpolder et al. | |
| 5,674,671 | A | 10/1997 | Brandon et al. | |
| 6,287,754 | B1 | 9/2001 | Melpolder et al. | |
| 6,329,128 | B1 | 12/2001 | Heland et al. | |
| 6,342,343 | B1 | 1/2002 | Toya | |

FOREIGN PATENT DOCUMENTS

| | | |
|---|---|---|
| EP | 0 260 593 | 9/1987 |
| EP | 0 902 322 A1 | 3/1999 |
| EP | 0 663 612 B1 | 3/2000 |
| GB | 1 439 402 | 6/1976 |

* cited by examiner

*Primary Examiner*—Thorl Chea
(74) *Attorney, Agent, or Firm*—J. Lanny Tucker; Louis M. Leichter

(57) ABSTRACT

Nonpolymeric fluorochemicals defined as by the following Structure I are useful in thermally developable materials. The fluorochemicals are defined as follows:

$$R_f—R—N(R_1)(R_2)(R_3)^+X^- \quad (I)$$

wherein $R_f$ is a straight or branched chain perfluoroalkyl group having 4 to 18 carbon atoms, R is a divalent linking group comprising at least 4 carbon atoms and a sulfide group in the chain, $R_1$, $R_2$, $R_3$ are independently hydrogen or alkyl groups or any two of $R_1$, $R_2$, and $R_3$ taken together can represent the carbon and nitrogen atoms necessary to provide a 5- to 7-membered heterocyclic ring with the cationic nitrogen atom, and $X^-$ is a monovalent anion.

27 Claims, No Drawings

THERMALLY DEVELOPABLE MATERIALS CONTAINING FLUOROCHEMICAL CONDUCTIVE LAYERS

FIELD OF THE INVENTION

This invention relates to thermally developable materials containing certain fluorochemicals in conductive layers. In particular, the invention relates to thermographic and photothermographic materials containing certain nonpolymeric fluorochemicals in backside conductive layers. The invention also relates to methods of imaging the thermally developable materials.

BACKGROUND OF THE INVENTION

Silver-containing thermographic and photothermographic imaging materials (that is, thermally developable imaging materials) that are imaged and/or developed using heat and without liquid processing have been known in the art for many years.

Silver-containing thermographic imaging materials are non-photo-sensitive materials that are used in a recording process wherein images are generated by the use of thermal energy. These materials generally comprise a support having disposed thereon (a) a relatively or completely non-photosensitive source of reducible silver ions, (b) a reducing composition (usually including a developer) for the reducible silver ions, and (c) a suitable hydrophilic or hydrophobic binder.

In a typical thermographic construction, the image-forming layers are based on silver salts of long chain fatty acids. Typically, the preferred non-photosensitive reducible silver source is a silver salt of a long chain aliphatic carboxylic acid having from 10 to 30 carbon atoms. The silver salt of behenic acid or mixtures of acids of similar molecular weight are generally used. At elevated temperatures, the silver of the silver carboxylate is reduced by a reducing agent for silver ion such as methyl gallate, hydroquinone, substituted-hydroquinones, hindered phenols, catechols, pyrogallol, ascorbic acid, and ascorbic acid derivatives, whereby an image of elemental silver is formed. Some thermographic constructions are imaged by contacting them with the thermal head of a thermographic recording apparatus such as a thermal printer or thermal facsimile. In such constructions, an anti-stick layer is coated on top of the imaging layer to prevent sticking of the thermographic construction to the thermal head of the apparatus utilized. The resulting thermographic construction is then heated to an elevated temperature, typically in the range of from about 60 to about 225° C., resulting in the formation of an image.

Silver-containing photothermographic imaging materials are photo-sensitive materials that are used in a recording process wherein an image is formed by imagewise exposure of the photothermographic material to specific electromagnetic radiation (for example, X-radiation, or ultraviolet, visible, or infrared radiation) and developed by the use of thermal energy. These materials, also known as "dry silver" materials, generally comprise a support having coated thereon: (a) a photocatalyst (that is, a photosensitive compound such as silver halide) that upon such exposure provides a latent image in exposed grains that are capable of acting as a catalyst for the subsequent formation of a silver image in a development step, (b) a relatively or completely non-photosensitive source of reducible silver ions, (c) a reducing composition (usually including a developer) for the reducible silver ions, and (d) a hydrophilic or hydrophobic binder. The latent image is then developed by application of thermal energy.

In such materials, the photosensitive catalyst is generally a photo-graphic type photosensitive silver halide that is considered to be in catalytic proximity to the non-photosensitive source of reducible silver ions. Catalytic proximity requires intimate physical association of these two components either prior to or during the thermal image development process so that when silver atoms $(Ag^0)_n$, also known as silver specks, clusters, nuclei or latent image, are generated by irradiation or light exposure of the photosensitive silver halide, those silver atoms are able to catalyze the reduction of the reducible silver ions within a catalytic sphere of influence around the silver atoms [D. H. Klosterboer, *Imaging Processes and Materials*, (*Neblette's Eighth Edition*), J. Sturge, V. Walworth, and A. Shepp, Eds., Van Nostrand-Reinhold, New York, 1989, Chapter 9, pp. 279–291]. It has long been understood that silver atoms act as a catalyst for the reduction of silver ions, and that the photosensitive silver halide can be placed in catalytic proximity with the non-photosensitive source of reducible silver ions in a number of different ways (see, for example, *Research Disclosure*, June 1978, item 17029). Other photosensitive materials, such as titanium dioxide, cadmium sulfide, and zinc oxide have also been reported to be useful in place of silver halide as the photocatalyst in photothermographic materials [see for example, Shepard, *J. Appl. Photog. Eng.* 1982, 8(5), 210–212, Shigeo et al., *Nippon Kagaku Kaishi*, 1994, 11, 992–997, and FR 2,254,047 (Robillard)].

The photosensitive silver halide may be made "in-situ," for example by mixing an organic or inorganic halide-containing source with a source of reducible silver ions to achieve partial metathesis and thus causing the in-situ formation of silver halide (AgX) grains throughout the silver source [see, for example, U.S. Pat. No. 3,457,075 (Morgan et al.)]. In addition, photosensitive silver halides and sources of reducible silver ions can be coprecipitated [see Yu. E. Usanov et al., *J. Imag. Sci. Tech.* 1996, 40, 104]. Alternatively, a portion of the reducible silver ions can be completely converted to silver halide, and that portion can be added back to the source of reducible silver ions (see Yu. E. Usanov et al., International Conference on Imaging Science, Sep. 7–11, 1998, pp. 67–70).

The silver halide may also be "preformed" and prepared by an "ex-situ" process whereby the silver halide (AgX) grains are prepared and grown separately. With this technique, one has the possibility of controlling the grain size, grain size distribution, dopant levels, and composition much more precisely, so that one can impart more specific properties to both the silver halide grains and the photothermographic material. The preformed silver halide grains may be introduced prior to and be present during the formation of the source of reducible silver ions. Co-precipitation of the silver halide and the source of reducible silver ions provides a more intimate mixture of the two materials [see for example U.S. Pat. No. 3,839,049 (Simons)]. Alternatively, the preformed silver halide grains may be added to and physically mixed with the source of reducible silver ions.

The non-photosensitive source of reducible silver ions is a material that contains reducible silver ions. Typically, the preferred non-photosensitive source of reducible silver ions is a silver salt of a long chain aliphatic carboxylic acid having from 10 to 30 carbon atoms, or mixtures of such salts. Such acids are also known as "fatty acids" or "fatty carboxylic acids". Silver salts of other organic acids or other organic compounds, such as silver imidazoles, silver tetrazoles, silver benzotriazoles, silver benzotetrazoles, silver benzothiazoles and silver acetylides may also be used. U.S. Pat. No. 4,260,677 (Winslow et al.) discloses the use of complexes of various inorganic or organic silver salts.

In photothermographic materials, exposure of the photographic silver halide to light produces small clusters containing silver atoms $(Ag^0)_n$. The imagewise distribution of these clusters, known in the art as a latent image, is generally not visible by ordinary means. Thus, the photosensitive material must be further developed to produce a visible image. This is accomplished by the reduction of silver ions that are in catalytic proximity to silver halide grains bearing the silver-containing clusters of the latent image. This produces a black-and-white image. The non-photosensitive silver source is catalytically reduced to form the visible black-and-white negative image while much of the silver halide, generally, remains as silver halide and is not reduced.

In photothermographic materials, the reducing agent for the reducible silver ions, often referred to as a "developer," may be any compound that, in the presence of the latent image, can reduce silver ion to metallic silver and is preferably of relatively low activity until it is heated to a temperature sufficient to cause the reaction. A wide variety of classes of compounds have been disclosed in the literature that function as developers for photothermographic materials. At elevated temperatures, the reducible silver ions are reduced by the reducing agent. In photothermographic materials, upon heating, this reaction occurs preferentially in the regions surrounding the latent image. This reaction produces a negative image of metallic silver having a color that ranges from yellow to deep black depending upon the presence of toning agents and other components in the imaging layer(s).

Differences Between Photothermography and Photography

The imaging arts have long recognized that the field of photothermography is clearly distinct from that of photography. Photothermographic materials differ significantly from conventional silver halide photographic materials that require processing with aqueous processing solutions.

As noted above, in photothermographic imaging materials, a visible image is created by heat as a result of the reaction of a developer incorporated within the material. Heating at 50° C. or more is essential for this dry development. In contrast, conventional photographic imaging materials require processing in aqueous processing baths at more moderate temperatures (from 30° C. to 50° C.) to provide a visible image.

In photothermographic materials, only a small amount of silver halide is used to capture light and a non-photosensitive source of reducible silver ions (for example a silver carboxylate) is used to generate the visible image using thermal development. Thus, the imaged photosensitive silver halide serves as a catalyst for the physical development process involving the non-photosensitive source of reducible silver ions and the incorporated reducing agent. In contrast, conventional wet-processed, black-and-white photographic materials use only one form of silver (that is, silver halide) that, upon chemical development, is itself at least partially converted into the silver image, or that upon physical development requires addition of an external silver source (or other reducible metal ions that form black images upon reduction to the corresponding metal). Thus, photothermographic materials require an amount of silver halide per unit area that is only a fraction of that used in conventional wet-processed photographic materials.

In photothermographic materials, all of the "chemistry" for imaging is incorporated within the material itself. For example, such materials include a developer (that is, a reducing agent for the reducible silver ions) while conventional photographic materials usually do not. Even in so-called "instant photography," the developer chemistry is physically separated from the photosensitive silver halide until development is desired. The incorporation of the developer into photothermographic materials can lead to increased formation of various types of "fog" or other undesirable sensitometric side effects. Therefore, much effort has gone into the preparation and manufacture of photothermographic materials to minimize these problems during the preparation of the photothermographic emulsion as well as during coating, use, storage, and post-processing handling.

Moreover, in photothermographic materials, the unexposed silver halide generally remains intact after development and the material must be stabilized against further imaging and development. In contrast, silver halide is removed from conventional photographic materials after solution development to prevent further imaging (that is in the aqueous fixing step).

In photothermographic materials, the binder is capable of wide variation and a number of binders (both hydrophilic and hydrophobic) are useful. In contrast, conventional photographic materials are limited almost exclusively to hydrophilic colloidal binders such as gelatin.

Because photothermographic materials require dry thermal processing, they present distinctly different problems and require different materials in manufacture and use, compared to conventional, wet-processed silver halide photographic materials. Additives that have one effect in conventional silver halide photographic materials may behave quite differently when incorporated in photothermographic materials where the underlying chemistry is significantly more complex. The incorporation of such additives as, for example, stabilizers, antifoggants, speed enhancers, supersensitizers, and spectral and chemical sensitizers in conventional photographic materials is not predictive of whether such additives will prove beneficial or detrimental in photothermographic materials. For example, it is not uncommon for a photographic antifoggant useful in conventional photographic materials to cause various types of fog when incorporated into photothermographic materials, or for supersensitizers that are effective in photographic materials to be inactive in photothermographic materials.

These and other distinctions between photothermographic and photographic materials are described in *Imaging Processes and Materials* (*Neblette's Eighth Edition*), noted above, *Unconventional Imaging Processes*, E. Brinckman et al. (Eds.), The Focal Press, London and New York, 1978, pp. 74–75, in Zou et al., *J. Imaging Sci. Technol.* 1996, 40, pp. 94–103, and in M. R. V. Sahyun, *J. Imaging Sci. Technol.* 1998, 42, 23.

Problem to be Solved

Many of the chemicals used to make supports or supported layers in thermally developable materials have electrically insulating properties, and electrostatic charges frequently build up on the materials during manufacture, packaging, and use. The accumulated charges can cause various problems. For example, in photothermographic materials containing photosensitive silver halides, accumulated electrostatic charge can generate light to which the silver halides are sensitive. This may result in imaging defects that are a particular problem where the images are used for medical diagnosis.

Build-up of electrostatic charge can also cause sheets of imageable material to stick together causing misfeeds and jamming within processing equipment. Additionally, accumulated electrostatic charge can attract dust or other particulate matter to the imageable material, thereby requiring more cleaning means so transport through the processing equipment and image quality of the material are not diminished.

Build-up of electrostatic charge also makes handling of developed sheets of imaged material more difficult. For example, a radiologist desires a static free sheet for viewing on the light boxes. This problem can be particularly severe when reviewing an imaged film that has been stored for later review. Many antistatic materials loose their effectiveness over time.

In general, electrostatic charge is related to surface resistivity (measured in ohm/sq) and charge level. Thus, while electrostatic charge control agents (or antistatic agents) can be included in any layer of an imaging material, the accumulation of electrostatic charge can be prevented by reducing the surface resistivity or by lowering the charge level, and this is usually done by including charge control agents in surface layers. Such surface layers may include what are known as "protective" overcoats or various backing layers in imaging materials. In thermographic and photothermographic materials, charge control agents may be incorporated into backing layers (such as antihalation layers of photothermographic materials) that are on the opposite side of the support as the imaging layers.

A wide variety of charge control agents, both inorganic and organic, have been devised and used for electrostatic charge control and numerous publications describe such agents. Some charge control agents are designed to increase surface layer conductivity while others are designed to control the generation of surface electrostatic charge. Various fluorochemicals have been widely used for the purpose of reducing the generation of surface electrostatic charge. U.S. Pat. No. 5,674,671 (Brandon et al.), for example, describes the use of certain fluoropolymers and nonpolymeric fluorochemicals in photographic materials (not thermally developable materials).

U.S. Pat. No. 6,287,754 (Melpolder et al.) describes thermally developable materials (both thermographic and photothermographic materials) that include fluorosurfactants as electroconductive agents in either of both of the protective overcoat layers and backing layers. The fluorosurfactants can be either nonionic or ionic in nature and generally include one or more aliphatic or polyalkylether chains. These compounds include the commercially available Fluorad™ FC-135 cationic fluorosurfactant (3M Corporation) that is a fluorinated alkyl quaternary ammonium iodide and ZONYL® FSN nonionic fluorosurfactant (E. I. DuPont de Nemours & Co.) that is a fluorinated polyethyleneoxide alcohol.

Fluorinated organic salts that are the reaction products of a polyoxyalkyleneamine with a fluorinated organic acid have also been described as electrostatic charge control agents in hydrophilic coatings used in non-thermally developable photographic materials. Polyoxyalkyleneamines that are useful for making such fluorinated organic salts include JEFFAMINE® (currently available from Huntsman Corp. and previously available from Texaco Chemical Co.). One such electrostatic charge control agent is the perfluorooctylsulfonyl (PFOS) salt of a polyoxyalkyleneamine described as Compound 1 in U.S. Pat. No. 4,975,363 (Cavallo et al.). These materials require isolation and purification.

U.S. Pat. No. 6,171,707 (Gomez et al.) describes the use of similar di-quaternary nitrogen polyoxyalkylene compounds having highly fluorinated alkylsulfonyl anions as antistatic agents in oleophilic polymeric binders coated from organic solvents. These compounds are particularly useful as antistatic agents in backing layers of photothermographic materials. The preferred compound of this class contains a $C_8F_{17}SO_3^-$ (perfluorooctylsulfonate) group on each end. However, it was recently discovered that materials containing perfluorooctylsulfonyl groups may present environmental concerns.

Copending and commonly assigned U.S. Ser. No. 10/107,551 (filed Mar. 27, 2002 by Sakizadeh, LaBelle, Orem, and Bhave) discloses environmentally suitable antistatic agents for (photo)thermographic materials comprising a fluorochemical that is a reaction product of $R_f$—$CH_2CH_2$—$SO_3H$ with an amine wherein $R_f$ comprises 4 or more fully fluorinated carbon atoms.

Despite the considerable research and knowledge in the art relating to the use of various fluorochemicals in conductive compositions and imaging materials, there remains a need for additional environmentally acceptable antistatic agents that promote high conductivity in thermally developable imaging materials.

SUMMARY OF THE INVENTION

This invention provides a thermally developable material comprising a support and having thereon at least one thermally developable layer on one side of the support, and on the opposing backside of the support, a conductive layer comprising as the sole antistatic agent(s), one or more nonpolymeric fluorochemicals represented by the following Structure I:

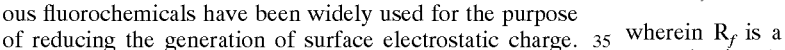

$$R_f—R—N(R_1)(R_2)(R_3)^+X^- \quad (I)$$

wherein $R_f$ is a straight or branched chain perfluoroalkyl group having 4 to 18 carbon atoms, R is a divalent linking group comprising at least 4 carbon atoms and a sulfide group in the chain, $R_1$, $R_2$, $R_3$ are independently hydrogen or alkyl groups or any two of $R_1$, $R_2$, and $R_3$ taken together can represent the carbon and nitrogen atoms necessary to provide a 5- to 7-membered heterocyclic ring with the cationic nitrogen atom, and $X^-$ is a monovalent anion.

This invention also provides a black-and-white thermographic material that comprises a support having on one side thereof one or more thermally-developable imaging layers comprising a binder and in reactive association, a non-photosensitive source of reducible silver ions and a reducing agent composition for the non-photosensitive source of reducible silver ions, and on the opposing backside of the support, a conductive layer comprising as the sole antistatic agent(s), one or more nonpolymeric fluorochemicals represented by the following Structure I:

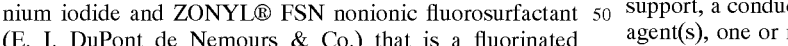

$$R_f—R—N(R_1)(R_2)(R_3)^+X^- \quad (I)$$

wherein $R_f$ is a straight or branched chain perfluoroalkyl group having 4 to 18 carbon atoms, R is a divalent linking group comprising at least 4 carbon atoms and a sulfide group in the chain, $R_1$, $R_2$, $R_3$ are independently hydrogen or alkyl groups or any two of $R_1$, $R_2$, and $R_3$ taken together can represent the carbon and nitrogen atoms necessary to provide a 5- to 7-membered heterocyclic ring with the cationic nitrogen atom, and $X^-$ is a monovalent anion.

Further, a photothermographic material of this invention comprises a support having on one side thereof one or more thermally developable imaging layers comprising a binder and in reactive association, a photosensitive silver halide, a non-photosensitive source of reducible silver ions, and a reducing agent composition for the non-photosensitive source reducible silver ions, and on the opposing backside of the support, a conductive layer comprising as the sole antistatic agent(s), one or more nonpolymeric fluorochemicals represented by the following Structure I:

$$R_f—R—N(R_1)(R_2)(R_3)^+X^- \quad (I)$$

wherein $R_f$ is a straight or branched chain perfluoroalkyl group having 4 to 18 carbon atoms, R is a divalent linking group comprising at least 4 carbon atoms and a sulfide group in the chain, $R_1$, $R_2$, $R_3$ are independently hydrogen or alkyl groups or any two of $R_1$, $R_2$, and $R_3$ taken together can represent the carbon and nitrogen atoms necessary to provide a 5- to 7-membered heterocyclic ring with the cationic nitrogen atom, and $X^-$ is a monovalent anion.

Preferred embodiments of the present invention include a black-and-white photothermographic material that comprises a support having thereon:

a) one or more thermally developable imaging layers each comprising
   - a hydrophobic binder, and in reactive association,
   - a photosensitive silver bromide or silver iodobromide,
   - a non-photosensitive source of reducible silver ions that includes one or more silver carboxylates at least one of which is silver behenate,
   - a reducing agent composition for the non-photosensitive source reducible silver ions that includes at least one hindered phenol, and
   - at least one toner, antifoggant, spectral sensitizing dye, or high contrast agent, or any combination thereof, b) a protective overcoat disposed over the one or more thermally developable imaging layers, c) on the opposing backside of the support, a conductive layer comprising an antihalation composition and as the sole antistatic agent(s), one or more compounds represented by Structure I-1 below wherein $R_f$ comprises 6 to 12 fully fluorinated carbon atoms:

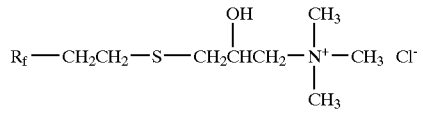

(I-1)

This invention also provides a method of forming a visible image comprising thermal imaging of the thermally developable materials of the present invention.

Still again, the present invention provides a method of forming a visible image comprising:

A) imagewise exposing the photothermographic material of the present invention to electromagnetic radiation to form a latent image, B) simultaneously or sequentially, heating the exposed photothermographic material to develop the latent image into a visible image.

In some embodiments, wherein the thermographic or photothermographic material comprises a transparent support, the image-forming method further comprises:

C) positioning the exposed and heat-developed thermographic or photothermographic material with the visible image therein between a source of imaging radiation and an imageable material that is sensitive to the imaging radiation, and D) exposing the imageable material to the imaging radiation through the visible image in the exposed and heat-developed photothermographic material to provide an image in the imageable material.

The present invention provides a number of advantages with the use of specific fluorochemicals on the backside of the thermally developable materials. More specifically, the present invention includes antistatic materials that reduce build-up of electrostatic charge, thus reducing the tendency of sheets of imageable material to stick together and to cause misfeeds and jamming within processing equipment. The present invention further provides materials with a reduced tendency to attract dust or other particulate matter, and also makes handling of developed sheets of imaged material easier because they do not lose their antistatic properties over time. Importantly, the antistatic agents used in the present invention are more environmentally acceptable compared to known fluorochemicals.

Some very specific advantages have been observed with the use of the specific fluorochemicals described herein. For example, Compound I-1 appears to provide a number of significant improvements particularly when compared with known fluorochemical charge control and antistatic materials. The improvements may be classified in terms of better stability with conventional antihalation dyes (such as that identified in the examples below as a squaraine dye Backcoat Dye BC-1), compatibility with the imaging chemistry, the possible use of lower concentration with improved conductivity, and improved film aging characteristics. These four very important improvements are described further in the experiments and examples provided below.

DETAILED DESCRIPTION OF THE INVENTION

The thermally developable materials of this invention include both thermographic and photothermographic materials. While the following discussion will often be directed primarily to the preferred photothermographic embodiments, it would be readily understood by one skilled in the imaging arts that thermographic materials can be similarly constructed (using one or more imaging layers) and used to provide black-and-white or color images using non-photosensitive silver salts, reducing compositions, binders, and other components known to be useful in such embodiments. In both thermographic and photothermographic materials, the nonpolymeric fluorochemicals described herein are generally incorporated into a separate conductive ("antistatic") layer on either or both sides of the support and preferably on the backside of the support.

The thermographic and photothermographic materials of this invention can be used in black-and-white or color thermography or photothermography and in electronically generated black-and-white or color hardcopy recording. They can be used in microfilm applications, in radiographic imaging (for example digital medical imaging), X-ray radiography, and in industrial radiography. Furthermore, the absorbance of these thermographic and photothermographic materials between 350 and 450 nm is desirably low (less than 0.5), to permit their use in the graphic arts area (for example, imagesetting and photo-typesetting), in the manufacture of printing plates, in contact printing, in duplicating ("duping"), and in proofing.

The thermographic and photothermographic materials of this invention are particularly useful for medical imaging of human or animal subjects in response to visible or X-radiation. Such applications include, but are not limited to, thoracic imaging, mammography, dental imaging, orthopedic imaging, general medical radiography, therapeutic radiography, veterinary radiography, and auto-radiography.

When used with X-radiation, the photothermographic materials of this invention may be used in combination with one or more phosphor intensifying screens, with phosphors incorporated within the photothermographic emulsion, or with a combination thereof. The materials of this invention are also useful for non-medical uses of visible or X-radiation (such as X-ray lithography and industrial radiography).

The photothermographic materials of this invention can be made sensitive to radiation of any suitable wavelength. Thus, in some embodiments, the materials are sensitive at ultraviolet, visible, infrared or near infrared wavelengths, of the electromagnetic spectrum. In preferred embodiments, the materials are sensitive to radiation greater than 700 nm. In other embodiments they are sensitive to X-radiation. Increased sensitivity to a particular region of the spectrum is imparted through the use of various sensitizing dyes.

The photothermographic materials of this invention are also useful for non-medical uses of visible or X-radiation (such as X-ray lithography and industrial radiography). In such imaging applications, it is often desirable that the photothermographic materials be "double-sided."

In the photothermographic materials of this invention, the components needed for imaging can be in one or more thermally developable layers on one side ("frontside") of the support. The layer(s) that contain the photosensitive photocatalyst (such as a photosensitive silver halide in photothermographic materials) or non-photosensitive source of reducible silver ions, or both, are referred to herein as photothermographic emulsion layer(s). The photocatalyst and the non-photosensitive source of reducible silver ions are in catalytic proximity (that is, in reactive association with each other) and preferably are in the same emulsion layer.

Similarly, in the thermographic materials of this invention, the components needed for imaging can be in one or more layers. The layer(s) that contain the non-photosensitive source of reducible silver ions are referred to herein as thermographic emulsion layer(s).

Where the materials contain imaging layers on one side of the support only, various non-imaging layers are usually disposed on the "backside" (non-emulsion or non-imaging side) of the materials, including at least one conductive layer, and optionally antihalation layer(s), protective layers, and transport enabling layers.

In such instances, various non-imaging layers can also be disposed on the "frontside" or imaging or emulsion side of the support, including protective topcoat layers, primer layers, interlayers, opacifying layers, antistatic layers, antihalation layers, acutance layers, auxiliary layers, and other layers readily apparent to one skilled in the art.

For some applications it may be useful that the photothermographic materials be "double-sided" and have photothermographic coatings on both sides of the support. In such constructions each side can also include one or more protective topcoat layers, primer layers, interlayers, antistatic layers, acutance layers, auxiliary layers, anti-crossover layers, and other layers readily apparent to one skilled in the art.

When the thermographic and photothermographic materials of this invention are heat-developed as described below in a substantially water-free condition after, or simultaneously with, imagewise exposure, a silver image (preferably a black-and-white silver image) is obtained.

Definitions

As used herein:

In the descriptions of the photothermographic materials of the present invention, "a" or "an" component refers to "at least one" of that component (for example, the specific nonpolymeric fluorochemicals in the backside conductive layer).

Heating in a substantially water-free condition as used herein, means heating at a temperature of from about 50° C. to about 250° C. with little more than ambient water vapor present. The term "substantially water-free condition" means that the reaction system is approximately in equilibrium with water in the air and water for inducing or promoting the reaction is not particularly or positively supplied from the exterior to the material. Such a condition is described in T. H. James, *The Theory of the Photographic Process*, Fourth Edition, Eastman Kodak Company, Rochester, N.Y., 1977, p. 374.

"Photothermographic material(s)" means a construction comprising at least one photothermographic emulsion layer or a photothermographic set of layers, wherein the photosensitive silver halide and the source of reducible silver ions are in one layer and the other essential components or desirable additives are distributed, as desired, in the same layer or in an adjacent coating layer, as well as any supports, topcoat layers, image-receiving layers, blocking layers, antihalation layers, subbing or priming layers. These materials also include multilayer constructions in which one or more imaging components are in different layers, but are in "reactive association" so that they readily come into contact with each other during imaging and/or development. For example, one layer can include the non-photosensitive source of reducible silver ions and another layer can include the reducing composition, but the two reactive components are in reactive association with each other.

"Thermographic materials" are similarly defined except that no photosensitive silver halide is present.

When used in photothermography, the term, "imagewise exposing" or "imagewise exposure" means that the material is imaged using any exposure means that provides a latent image using electromagnetic radiation. This includes, for example, by analog exposure where an image is formed by projection onto the photosensitive material as well as by digital exposure where the image is formed one pixel at a time such as by modulation of scanning laser radiation.

When used in thermography, the term, "imagewise exposing" or "imagewise exposure" means that the material is imaged using any means that provides an image using heat. This includes, for example, by analog exposure where an image is formed by differential contact heating through a mask using a thermal blanket or infrared heat source, as well as by digital exposure where the image is formed one pixel at a time such as by modulation of thermal print-heads.

"Catalytic proximity" or "reactive association" means that the materials are in the same layer or in adjacent layers so that they readily come into contact with each other during thermal imaging and development.

"Emulsion layer", "imaging layer", or "thermographic emulsion layer," or "photothermographic emulsion layer" means a layer of a thermographic or photothermographic material that contains the photosensitive silver halide (when used) and/or non-photosensitive source of reducible silver ions. It can also mean a layer of the thermographic or photothermographic material that contains, in addition to the photosensitive silver halide (when used) and/or non-photosensitive source of reducible ions, additional essential components and/or desirable additives. These layers are usually on what is known as the "frontside" of the support.

"Photocatalyst" means a photosensitive compound such as silver halide that, upon exposure to radiation, provides a compound that is capable of acting as a catalyst for the subsequent development of the image-forming material.

Many of the materials used herein are provided as a solution. The term "active ingredient" means the amount or the percentage of the desired material contained in a sample. All amounts listed herein are the amount of active ingredient added.

"Ultraviolet region of the spectrum" refers to that region of the spectrum less than or equal to 410 nm, and preferably from about 100 nm to about 410 nm, although parts of these ranges may be visible to the naked human eye. More preferably, the ultraviolet region of the spectrum is the region of from about 190 to about 405 nm.

"Visible region of the spectrum" refers to that region of the spectrum of from about 400 nm to about 700 nm.

"Short wavelength visible region of the spectrum" refers to that region of the spectrum of from about 400 nm to about 450 nm.

"Red region of the spectrum" refers to that region of the spectrum of from about 600 nm to about 700 nm.

"Infrared region of the spectrum" refers to that region of the spectrum of from about 700 nm to about 1400 nm.

"Non-photosensitive" means not intentionally light sensitive.

The sensitometric terms "photospeed", "speed", or "photographic speed" (also known as sensitivity), absorbance, contrast, $D_{min}$, and $D_{max}$ have conventional definitions known in the imaging arts. In photothermographic materials, $D_{min}$ is considered herein as image density achieved when the photothermographic material is thermally developed without prior exposure to radiation. It is the average of eight lowest density values on the exposed side of the fiducial mark. In thermographic materials, $D_{min}$ is considered herein as image density in the non-thermally imaged areas of the thermographic material.

The sensitometric term absorbance is another term for optical density (OD).

"Transparent" means capable of transmitting visible light or imaging radiation without appreciable scattering or absorption.

As used herein, the phrase "organic silver coordinating ligand" refers to an organic molecule capable of forming a bond with a silver atom. Although the compounds so formed are technically silver coordination compounds they are also often referred to as silver salts.

The terms "double-sided" and "double-faced coating" are used to define photothermographic materials having one or more of the same or different thermally developable emulsion layers disposed on both sides (front and back) of the support.

In the compounds described herein, no particular double bond geometry (for example, cis or trans) is intended by the structures drawn. Similarly, in compounds having alternating single and double bonds and localized charges are drawn as a formalism. In reality, both electron and charge delocalization exists throughout the conjugated chain.

As is well understood in this art, for the chemical compounds herein described, substitution is not only tolerated, but is often advisable and various substituents are anticipated on the compounds used in the present invention unless otherwise stated. Thus, when a compound is referred to as "having the structure" of a given formula, any substitution that does not alter the bond structure of the formula or the shown atoms within that structure is included within the formula, unless such substitution is specifically excluded by language (such as "free of carboxy-substituted alkyl"). For example, where a benzene ring structure is shown (including fused ring structures), substituent groups may be placed on the benzene ring structure, but the atoms making up the benzene ring structure may not be replaced.

As a means of simplifying the discussion and recitation of certain substituent groups, the term "group" refers to chemical species that may be substituted as well as those that are not so substituted. Thus, the term "group," such as "alkyl group" is intended to include not only pure hydrocarbon alkyl chains, such as methyl, ethyl, n-propyl, t-butyl, cyclohexyl, iso-octyl, and octadecyl, but also alkyl chains bearing substituents known in the art, such as hydroxyl, alkoxy, phenyl, halogen atoms (F, Cl, Br, and I), cyano, nitro, amino, and carboxy. For example, alkyl group includes ether and thioether groups (for example $CH_3—CH_2—CH_2—O—CH_2—$ and $CH_3—CH_2—CH_2—S—CH_2—$), haloalkyl, nitroalkyl, alkylcarboxy, carboxyalkyl, carboxamido, hydroxyalkyl, sulfoalkyl, and other groups readily apparent to one skilled in the art. Substituents that adversely react with other active ingredients, such as very strongly electrophilic or oxidizing-substituents, would, of course, be excluded by the ordinarily skilled artisan as not being inert or harmless.

*Research Disclosure* is a publication of Kenneth Mason Publications Ltd., Dudley House, 12 North Street, Emsworth, Hampshire PO10 7DQ England. It is also available from Emsworth Design Inc., 147 West 24th Street, New York, N.Y. 10011.

Other aspects, advantages, and benefits of the present invention are apparent from the detailed description, examples, and claims provided in this application.

The Photocatalyst

As noted above, the photothermographic materials of the present invention include one or more photocatalysts in the photothermographic emulsion layer(s). Useful photocatalysts are typically silver halides such as silver bromide, silver iodide, silver chloride, silver bromoiodide, silver chlorobromoiodide, silver chlorobromide, and others readily apparent to one skilled in the art. Mixtures of silver halides can also be used in any suitable proportion. Silver bromide and silver bromoiodide are more preferred, with the latter silver halide generally having up to 10 mol % silver iodide. Typical techniques for preparing and precipitating silver halide grains are described in *Research Disclosure*, 1978, item 17643.

The shape of the photosensitive silver halide grains used in the present invention is in no way limited. The silver halide grains may have any crystalline habit including, but not limited to, cubic, octahedral, tetrahedral, orthorhombic, rhombic, dodecahedral, other polyhedral, tabular, laminar, twinned, or platelet morphologies and may have epitaxial growth of crystals thereon. If desired, a mixture of these crystals can be employed. Silver halide grains having cubic and tabular morphology are preferred.

The silver halide grains may have a uniform ratio of halide throughout. They may have a graded halide content, with a continuously varying ratio of, for example, silver bromide and silver iodide or they may be of the core-shell type, having a discrete core of one or more silver halides, and a discrete shell of one or more different silver halides. Core-shell silver halide grains useful in photothermographic materials and methods of preparing these materials are described for example in U.S. Pat. No. 5,382,504 (Shor et al.), incorporated herein by reference. Iridium and/or copper doped core-shell and non-core-shell grains are described in U.S. Pat. No. 5,434,043 (Zou et al.) and U.S. Pat. No. 5,939,249 (Zou), both incorporated herein by reference.

The photosensitive silver halide can be added to (or formed within) the emulsion layer(s) in any fashion as long as it is placed in catalytic proximity to the non-photosensitive source of reducible silver ions.

It is preferred that the silver halides be preformed and prepared by an ex-situ process. The silver halide grains prepared ex-situ may then be added to and physically mixed with the non-photosensitive source of reducible silver ions.

It is more preferable to form the source of reducible silver ions in the presence of ex-situ-prepared silver halide. In this process, the source of reducible silver ions, such as a long chain fatty acid silver carboxylate (commonly referred to as a silver "soap"), is formed in the presence of the preformed silver halide grains. Co-precipitation of the reducible source of silver ions in the presence of silver halide provides a more intimate mixture of the two materials [see, for example U.S. Pat. No. 3,839,049 (Simons)]. Materials of this type are often referred to as "preformed soaps".

The silver halide grains used in the imaging formulations can vary in average diameter of up to several micrometers ($\mu$m) depending on their desired use. Preferred silver halide grains are those having an average particle size of from about 0.01 to about 1.5 $\mu$m, more preferred are those having an average particle size of from about 0.03 to about 1.0 $\mu$m, and most preferred are those having an average particle size of from about 0.05 to about 0.8 $\mu$m. Those of ordinary skill in the art understand that there is a finite lower practical limit for silver halide grains that is partially dependent upon the wavelengths to which the grains are spectrally sensitized. Such a lower limit, for example, is typically from about 0.01 to about 0.005 $\mu$m.

The average size of the photosensitive doped silver halide grains is expressed by the average diameter if the grains are spherical, and by the average of the diameters of equivalent circles for the projected images if the grains are cubic or in other non-spherical shapes.

Grain size may be determined by any of the methods commonly employed in the art for particle size measurement. Representative methods are described by in "Particle Size Analysis," ASTM Symposium on Light Microscopy, R. P. Loveland, 1955, pp. 94–122, and in C. E. K. Mees and T. H. James, *The Theory of the Photographic Process*, Third Edition, Macmillan, New York, 1966, Chapter 2. Particle size measurements may be expressed in terms of the projected areas of grains or approximations of their diameters. These will provide reasonably accurate results if the grains of interest are substantially uniform in shape.

Preformed silver halide emulsions used in the material of this invention can be prepared by aqueous or organic processes and can be unwashed or washed to remove soluble salts. In the latter case, the soluble salts can be removed by ultrafiltration, by chill setting and leaching, or by washing the coagulum [for example, by the procedures described in U.S. Pat. No. 2,618,556 (Hewitson et al.), U.S. Pat. No. 2,614,928 (Yutzy et al.), U.S. Pat. No. 2,565,418 (Yackel), U.S. Pat. No. 3,241,969 (Hart et al.), and U.S. Pat. No. 2,489,341 (Waller et al.)].

It is also effective to use an in-situ process in which a halide-containing compound is added to an organic silver salt to partially convert the silver of the organic silver salt to silver halide. The halogen-containing compound can be inorganic (such as zinc bromide or lithium bromide) or organic (such as N-bromosuccinimide).

Mixtures of both preformed and in-situ generated silver halide may be used if desired.

Additional methods of preparing these silver halide and organic silver salts and manners of blending them are described in *Research Disclosure*, June 1978, item 17029, U.S. Pat. No. 3,700,458 (Lindholm), U.S. Pat. No. 4,076,539 (Ikenoue et al.), and JP Applications 13224/74, 42529/76, and 17216/75.

In some instances, it may be helpful to prepare the photosensitive silver halide grains in the presence of a hydroxy-tetrazindene (such as 4-hydroxy-6-methyl-1,3,3a,7-tetrazaindene or an N-heterocyclic compound comprising at least one mercapto group (such as 1-phenyl-5-mercaptotetrazole) to provide increased photospeed. Details of this procedure are provided in U.S. Pat. No. 6,413,710B1 (Shor et al.), that is incorporated herein by reference.

The one or more light-sensitive silver halides used in the photothermographic materials of the present invention are preferably present in an amount of from about 0.005 to about 0.5 mole, more preferably from about 0.01 to about 0.25 mole, and most preferably from about 0.03 to about 0.15 mole, per mole of non-photosensitive source of reducible silver ions.

Chemical Sensitizers

The photosensitive silver halides used in photothermographic features of the invention may be may be employed without modification. However, one or more conventional chemical sensitizers may be used in the preparation of the photosensitive silver halides to increase photospeed. Such compounds may contain sulfur, tellurium, or selenium, or may comprise a compound containing gold, platinum, palladium, ruthenium, rhodium, iridium, or combinations thereof, a reducing agent such as a tin halide or a combination of any of these. The details of these materials are provided for example, in T. H. James, *The Theory of the Photographic Process*, Fourth Edition, Eastman Kodak Company, Rochester, N.Y., 1977, Chapter 5, pp. 149–169. Suitable conventional chemical sensitization procedures are also described in U.S. Pat. No. 1,623,499 (Sheppard et al.), U.S. Pat. No. 2,399,083 (Waller et al.), U.S. Pat. No. 3,297,447 (McVeigh), U.S. Pat. No. 3,297,446 (Dunn), U.S. Pat. No. 5,049,485 (Deaton), U.S. Pat. No. 5,252,455 (Deaton), U.S. Pat. No. 5,391,727 (Deaton), U.S. Pat. No. 5,912,111 (Lok et al.), U.S. Pat. No. 5,759,761 (Lushington et al.), and EP 0 915 371A1 (Lok et al.).

In addition, mercaptotetrazoles and tetraazindenes as described in U.S. Pat. No. 5,691,127 (Daubendiek et al.), incorporated herein by reference, can be used as suitable addenda for tabular silver halide grains.

When used, sulfur sensitization is usually performed by adding a sulfur sensitizer and stirring the emulsion at an appropriate temperature predetermined time. Examples of sulfur sensitizers include compounds such as thiosulfates, thioureas, thiazoles, rhodanines, thiosulfates and thioureas. In one preferred embodiment, chemical sensitization is achieved by oxidative decomposition of a sulfur-containing spectral sensitizing dye in the presence of a photothermographic emulsion. Such sensitization is described in U.S. Pat. No. 5,891,615 (Winslow et al.), incorporated herein by reference.

In another embodiment, certain substituted and unsubstituted thiourea compounds can be used as chemical sensitizers. Particularly useful tetra-substituted thioureas are described in U.S. Pat. No. 6,368,779 (Lynch et al.), that is incorporated herein by reference.

Other useful chemical sensitizers include certain tellurium-containing compounds that are described in copending and commonly assigned U.S. Ser. No. 09/975,909 (filed Oct. 11, 2001 by Lynch, Opatz, Shor, Simpson, Willett, and Gysling), that is incorporated herein by reference.

Combinations of gold (3+)-containing compounds and either sulfur- or tellurium-containing compounds are also useful as chemical sensitizers as described in U.S. Pat. No. 6,423,481 (Simpson et al.) that is also incorporated herein by reference.

Still other useful chemical sensitizers include certain selenium-containing compounds that are described in U.S. Pat. No. 6,620,577 (Lynch et al.), that is also incorporated herein by reference.

The chemical sensitizers can be used in making the silver halide emulsions in conventional amounts that generally depend upon the average size of the silver halide grains. Generally, the total amount is at least $10^{-10}$ mole per mole of total silver, and preferably from about $10^{-8}$ to about $10^{-2}$ mole per mole of total silver for silver halide grains having an average size of from about 0.01 to about 2 $\mu$m. The upper limit can vary depending upon the compound(s) used, the level of silver halide and the average grain size, and would be readily determinable by one of ordinary skill in the art.

Spectral Sensitizers

The photosensitive silver halides used in the photothermographic features of the invention may be spectrally sensitized with various spectral sensitizing dyes that are known to enhance silver halide sensitivity to ultraviolet, visible, and/or infrared radiation. Non-limiting examples of sensitizing dyes that can be employed include cyanine dyes, merocyanine dyes, complex cyanine dyes, complex merocyanine dyes, holopolar cyanine dyes, hemicyanine dyes, styryl dyes, and hemioxanol dyes. Cyanine dyes are particularly useful. The cyanine dyes preferably include benzothiazole, benzoxazole, and benzoselenazole dyes that include one or more thioalkyl, thioaryl, or thioether groups. Suitable visible sensitizing dyes such as those described in U.S. Pat. No. 3,719,495 (Lea), U.S. Pat. No. 4,439,520 (Kofron et al.), and U.S. Pat. No. 5,281,515 (Delprato et al.) are effective in the practice of the invention. Suitable infrared sensitizing dyes such as those described in U.S. Pat. No. 5,393,654 (Burrows et al.), U.S. Pat. No. 5,441,866 (Miller et al.) and U.S. Pat. No. 5,541,054 (Miller et al.) are also effective in the practice of this invention. A summary of generally useful spectral sensitizing dyes is contained in *Research Disclosure*, item 308119, Section IV, December, 1989. Additional classes of dyes useful for spectral sensitization, including sensitization at other wavelengths are described in *Research Disclosure*, 1994, item 36544, section V. All of the references and patents above are incorporated herein by reference.

An appropriate amount of spectral sensitizing dye added is generally about $10^{-10}$ to $10^{-1}$ mole, and preferably, about $10^{-7}$ to $10^{-2}$ mole per mole of silver halide.

Non-Photosensitive Source of Reducible Silver Ions

The non-photosensitive source of reducible silver ions used in the thermographic and photothermographic materials of this invention can be any metal-organic compound that contains reducible silver (1+) ions. Such compounds are generally silver salts of silver coordinating ligands. Preferably, it is an organic silver salt that is comparatively stable to light and forms a silver image when heated to 50° C. or higher in the presence of an exposed photocatalyst (such as silver halide, when used in a photothermographic material) and a reducing composition.

Silver salts of organic acids including silver salts of long-chain carboxylic acids are preferred. The chains typically contain 10 to 30, and preferably 15 to 28, carbon atoms. Suitable organic silver salts include silver salts of organic compounds having a carboxylic acid group. Examples thereof include a silver salt of an aliphatic carboxylic acid or a silver salt of an aromatic carboxylic acid. Preferred examples of the silver salts of aliphatic carboxylic acids include silver behenate, silver arachidate, silver stearate, silver oleate, silver laurate, silver caprate, silver myristate, silver palmitate, silver maleate, silver fumarate, silver tartarate, silver furoate, silver linoleate, silver butyrate, silver camphorate, and mixtures thereof. Preferably, at least silver behenate is used alone or in mixtures with other silver salts.

Representative examples of useful silver salts of aromatic carboxylic acid and other carboxylic acid group-containing compounds include, but are not limited to, silver benzoate, silver substituted-benzoates (such as silver 3,5-dihydroxybenzoate, silver o-methylbenzoate, silver m-methylbenzoate, silver p-methylbenzoate, silver 2,4-dichlorobenzoate, silver acetamidobenzoate, silver p-phenylbenzoate), silver tannate, silver phthalate, silver terephthalate, silver salicylate, silver phenylacetate, and silver pyromellitate.

Silver salts of aliphatic carboxylic acids containing a thioether group as described in U.S. Pat. No. 3,330,663 (Weyde et al.) are also useful. Soluble silver carboxylates comprising hydrocarbon chains incorporating ether or thioether linkages, or sterically hindered substitution in the $\alpha$- (on a hydrocarbon group) or ortho- (on an aromatic group) position, and displaying increased solubility in coating solvents and affording coatings with less light scattering can also be used. Such silver carboxylates are described in U.S. Pat. No. 5,491,059 (Whitcomb). Mixtures of any of the silver salts described herein can also be used if desired.

Silver salts of dicarboxylic acids are also useful. Such acids may be aliphatic, aromatic, or heterocyclic. Examples of such acids include, for example, phthalic acid, glutamic acid, or homo-phthalic acid.

Silver salts of sulfonates are also useful in the practice of this invention. Such materials are described for example in U.S. Pat. No. 4,504,575 (Lee). Silver salts of sulfosuccinates are also useful as described for example in EP 0 227 141A1 (Leenders et al.).

Silver salts of compounds containing mercapto or thione groups and derivatives thereof can also be used. Preferred examples of these compounds include, but are not limited to, a heterocyclic nucleus containing 5 or 6 atoms in the ring, at least one of which is a nitrogen atom, and other atoms being carbon, oxygen, or sulfur atoms. Such heterocyclic nuclei include, but are not limited to, triazoles, oxazoles, thiazoles, thiazolines, imidazoles, diazoles, pyridines, and triazines. Representative examples of these silver salts include, but are not limited to, a silver salt of 3-mercapto-4-phenyl-1,2,4-triazole, a silver salt of 5-carboxylic-1-methyl-2-phenyl-4-thiopyridine, a silver salt of mercaptotriazine, a silver salt of 2-mercaptobenzoxazole, silver salts as described in U.S. Pat. No. 4,123,274 (Knight et al.) (for example, a silver salt of a 1,2,4-mercaptothiazole derivative, such as a silver salt of 3-amino-5-benzylthio-1,2,4-thiazole), and a silver salt of thione compounds [such as a silver salt of 3-(2-carboxyethyl)-4-methyl-4-thiazoline-2-thione as described in U.S. Pat. No. 3,785,830 (Sullivan et al.)].

Examples of other useful silver salts of mercapto or thione substituted compounds that do not contain a heterocyclic nucleus include but are not limited to, a silver salt of thioglycolic acids such as a silver salt of an S-alkylthioglycolic acid (wherein the alkyl group has from 12 to 22 carbon atoms), a silver salt of a dithiocarboxylic acid such as a silver salt of a dithioacetic acid, and a silver salt of a thioamide.

In some embodiments, a silver salt of a compound containing an imino group is preferred, especially in aqueous-based imaging formulations. Preferred examples of these compounds include, but are not limited to, silver salts of benzotriazole and substituted derivatives thereof (for example, silver methylbenzotriazole and silver 5-chlorobenzotriazole), silver salts of 1,2,4-triazoles or 1-H-tetrazoles such as phenylmercaptotetrazole as described in U.S. Pat. No. 4,220,709 (deMauriac), and silver salts of imidazoles and imidazole derivatives as described in U.S. Pat. No. 4,260,677 (Winslow et al.). Particularly useful silver salts of this type are the silver salts of benzotriazole and substituted derivatives thereof. A silver salt of benzotriazole is preferred in aqueous-based thermographic and photothermographic formulations.

Moreover, silver salts of acetylenes can also be used as described, for example in U.S. Pat. No. 4,761,361 (Ozaki et al.) and U.S. Pat. No. 4,775,613 (Hirai et al.).

Organic silver salts that are particularly useful in organic solvent-based photothermographic materials include silver carboxylates (both aliphatic and aromatic carboxylates), silver triazolates, silver sulfonates, silver sulfo-succinates, and silver acetylides. Silver salts of long-chain aliphatic carboxylic acids containing 15 to 28, carbon atoms and silver salts are particularly preferred.

It is also convenient to use silver half soaps. A preferred example of a silver half soap is an equimolar blend of silver carboxylate and carboxylic acid, which analyzes for about 14.5% by weight solids of silver in the blend and which is prepared by precipitation from an aqueous solution of an ammonium or an alkali metal salt of a commercially available fatty carboxylic acid, or by addition of the free fatty acid to the silver soap. For transparent films a silver carboxylate full soap, containing not more than about 15% of free fatty carboxylic acid and analyzing for about 22% silver, can be used. For opaque thermographic and photothermographic materials, different amounts can be used.

The methods used for making silver soap emulsions are well known in the art and are disclosed in *Research Disclosure*, April 1983, item 22812, *Research Disclosure*, October 1983, item 23419, U.S. Pat. No. 3,985,565 (Gabrielsen et al.) and the references cited above.

Non-photosensitive sources of reducible silver ions can also be provided as core-shell silver salts such as those described in U.S. Pat. No. 6,355,408 (Whitcomb et al.), that is incorporated herein by reference. These silver salts include a core comprised of one or more silver salts and a shell having one or more different silver salts.

Another useful source of non-photosensitive reducible silver ions in the practice of this invention are the silver dimer compounds that comprise two different silver salts as described in U.S. Pat. No. 6,472,131 (Whitcomb), that is incorporated herein by reference. Such non-photosensitive silver dimer compounds comprise two different silver salts, provided that when the two different silver salts comprise straight-chain, saturated hydrocarbon groups as the silver coordinating ligands, those ligands differ by at least 6 carbon atoms.

Still other useful sources of non-photosensitive reducible silver ions in the practice of this invention are the silver core-shell compounds comprising a primary core comprising one or more photosensitive silver halides, or one or more non-photosensitive inorganic metal salts or non-silver containing organic salts, and a shell at least partially covering the primary core, wherein the shell comprises one or more non-photosensitive silver salts, each of which silver salts comprises a organic silver coordinating ligand. Such compounds are described in copending and commonly assigned U.S. Ser. No. 10/208,603 (filed Jul. 30, 2002 by Bokhonov, Burleva, Whitcomb, Howlader, and Leichter), that is incorporated herein by reference.

As one skilled in the art would understand, the non-photosensitive source of reducible silver ions can include various mixtures of the various silver salt compounds described herein, in any desirable proportions.

When used in photothermographic materials, the photocatalyst and the non-photosensitive source of reducible silver ions must be in catalytic proximity (that is, reactive association). It is preferred that these reactive components be present in the same emulsion layer.

The one or more non-photosensitive sources of reducible silver ions are preferably present in an amount of about 5% by weight to about 70% by weight, and more preferably, about 10% to about 50% by weight, based on the total dry weight of the emulsion layers. Stated another way, the amount of the sources of reducible silver ions is generally present in an amount of from about 0.001 to about 0.2 $mol/m^2$ of the dry photothermographic material, and preferably from about 0.01 to about 0.05 $mol/m^2$ of that material.

The total amount of silver (from all silver sources) in the thermographic and photothermographic materials is generally at least 0.002 $mol/m^2$ and preferably from about 0.01 to about 0.05 $mol/m^2$.

Reducing Agents

When used in a photothermographic material, the reducing agent (or reducing agent composition comprising two or more components) for the source of reducible silver ions can be any material, preferably an organic material, that can reduce silver (1+) ion to metallic silver.

Conventional photographic developers can be used as reducing agents, including aromatic di- and tri-hydroxy compounds (such as hydroquinones, gallatic acid and gallic acid derivatives, catechols, and pyrogallols), aminophenols (for example, N-methylaminophenol), p-phenylenediamines, alkoxynaphthols (for example, 4-methoxy-1-naphthol), pyrazolidin-3-one type reducing agents (for example PHENIDONE®), pyrazolin-5-ones, polyhydroxy spiro-bis-indanes, indan-1,3-dione derivatives, hydroxytetrone acids, hydroxytetronimides, hydroxylamine derivatives such as for example those described in U.S. Pat. No. 4,082,901 (Laridon et al.), hydrazine derivatives, hindered phenols, amidoximes, azines, reductones (for example, ascorbic acid and ascorbic acid derivatives), leuco dyes, and other materials readily apparent to one skilled in the art.

When a silver benzotriazole silver source is used, ascorbic acid reducing agents are preferred. An "ascorbic acid" reducing agent (also referred to as a developer or developing agent) means ascorbic acid, complexes, and derivatives thereof. Ascorbic acid developing agents are described in a considerable number of publications in photographic processes, including U.S. Pat. No. 5,236,816 (Purol et al.) and references cited therein. Useful ascorbic acid developing agents include ascorbic acid and the analogues, isomers and derivatives thereof. Such compounds include, but are not limited to, D- or L-ascorbic acid, sugar-type derivatives thereof (such as sorboascorbic acid, γ-lactoascorbic acid, 6-desoxy-L-ascorbic acid, L-rhamnoascorbic acid, imino-6-desoxy-L-ascorbic acid, glucoascorbic acid, fucoascorbic acid, glucoheptoascorbic acid, maltoascorbic acid, L-arabosascorbic acid), sodium ascorbate, potassium ascorbate, isoascorbic acid (or L-erythroascorbic acid), and salts thereof (such as alkali metal, ammonium or others known in the art), endiol type ascorbic acid, an enaminol type ascorbic acid, a thioenol type ascorbic acid, and an enamin-thiol type ascorbic acid, as described for example in U.S. Pat. No. 5,498,511 (Yamashita et al.), EP 0 585 792A1 (Passarella et al.), EP 0 573 700A1 (Lingier et al.), EP 0 588 408A1 (Hieronymus et al.), U.S. Pat. No. 5,089,819

(Knapp), U.S. Pat. No. 5,278,035 (Knapp), U.S. Pat. No. 5,384,232 (Bishop et al.), U.S. Pat. No. 5,376,510 (Parker et al.), Japanese Kokai 7-56286 (Toyoda), U.S. Pat. No. 2,688,549 (James et al.), and *Research Disclosure*, item 37152, March 1995. D-, L-, or D,L-ascorbic acid (and alkali metal salts thereof) or isoascorbic acid (or alkali metal salts thereof) are preferred. Mixtures of these developing agents can be used if desired.

When a silver carboxylate silver source is used in a photothermographic material, hindered phenol reducing agents are preferred. In some instances, the reducing agent composition comprises two or more components such as a hindered phenol developer and a co-developer that can be chosen from the various classes of co-developers and reducing agents described below. Ternary developer mixtures involving the further addition of contrast enhancing agents are also useful. Such contrast enhancing agents can be chosen from the various classes of reducing agents described below. Hindered phenol reducing agents are preferred (alone or in combination with one or more high-contrast co-developing agents and co-developer contrast enhancing agents).

"Hindered phenol reducing agents" are compounds that contain only one hydroxy group on a given phenyl ring and have at least one additional substituent located ortho to the hydroxy group. Hindered phenol reducing agents may contain more than one hydroxy group as long as each hydroxy group is located on different phenyl rings. Hindered phenol reducing agents include, for example, binaphthols (that is dihydroxybinaphthyls), biphenols (that is dihydroxybiphenyls), bis(hydroxynaphthyl)methanes, bis(hydroxyphenyl)methanes (that is bisphenols), hindered phenols, and hindered naphthols, each of which may be variously substituted.

Representative binaphthols include, but are not limited, to 1,1'-bi-2-naphthol, 1,1'-bi-4-methyl-2-naphthol and 6,6'-dibromo-bi-2-naphthol. For additional compounds see U.S. Pat. No. 3,094,417 (Workman) and U.S. Pat. No. 5,262,295 (Tanaka et al.), both incorporated herein by reference.

Representative biphenols include, but are not limited, to 2,2'-dihydroxy-3,3'-di-t-butyl-5,5-dimethylbiphenyl, 2,2'-dihydroxy-3,3',5,5'-tetra-t-butylbiphenyl, 2,2'-dihydroxy-3,3'-di-t-butyl-5,5'-dichloro-biphenyl, 2-(2-hydroxy-3-t-butyl-5-methylphenyl)-4-methyl-6-n-hexylphenol, 4,4'-dihydroxy-3,3',5,5'-tetra-t-butylbiphenyl and 4,4'-dihydroxy-3,3',5,5'-tetra-methylbiphenyl. For additional compounds see U.S. Pat. No. 5,262,295 (noted above).

Representative bis(hydroxynaphthyl)methanes include, but are not limited to, 4,4'-methylenebis(2-methyl-1-naphthol). For additional compounds see U.S. Pat. No. 5,262,295 (noted above).

Representative bis(hydroxyphenyl)methanes include, but are not limited to, bis(2-hydroxy-3-t-butyl-5-methylphenyl) methane (CAO-5), 1,1'-bis(2-hydroxy-3,5-dimethylphenyl)-3,5,5-trimethylhexane (NONOX® or PERMANAX WSO), 1,1'-bis(3,5-di-t-butyl-4-hydroxyphenyl)methane, 2,2'-bis(4-hydroxy-3-methylphenyl)propane, 4,4'-ethylidene-bis(2-t-butyl-6-methylphenol), 2,2'-isobutylidene-bis(4,6-dimethylphenol) (LOWINOX® 221B46), and 2,2'-bis(3,5-dimethyl-4-hydroxyphenyl)propane. For additional compounds see U.S. Pat. No. 5,262,295 (noted above).

Representative hindered phenols include, but are not limited to, 2,6-di-t-butylphenol, 2,6-di-t-butyl-4-methylphenol, 2,4-di-t-butylphenol, 2,6-dichlorophenol, 2,6-dimethylphenol and 2-t-butyl-6-methylphenol.

Representative hindered naphthols include, but are not limited to, 1-naphthol, 4-methyl-1-naphthol, 4-methoxy-1-naphthol, 4-chloro-1-naphthol and 2-methyl-1-naphthol. For additional compounds see U.S. Pat. No. 5,262,295 (noted above).

Mixtures of hindered phenol reducing agents can be used if desired.

More specific alternative reducing agents that have been disclosed in dry silver systems including amidoximes such as phenylamidoxime, 2-thienylamidoxime and p-phenoxyphenylamidoxime, azines (for example, 4-hydroxy-3,5-dimethoxybenzaldehydrazine), a combination of aliphatic carboxylic acid aryl hydrazides and ascorbic acid [such as 2,2'-bis(hydroxymethyl)-propionyl-β-phenyl hydrazide in combination with ascorbic acid], a combination of polyhydroxy-benzene and hydroxylamine, a reductone and/or a hydrazine [for example, a combination of hydroquinone and bis(ethoxyethyl)hydroxylamine], piperidino-hexose reductone or formyl-4-methylphenylhydrazine, hydroxamic acids (such as phenylhydroxamic acid, p-hydroxyphenylhydroxamic acid, and α-alanine-hydroxamic acid), a combination of azines and sulfonamidophenols (for example, phenothiazine and 2,6-dichloro-4-benzenesulfonamidophenol), α-cyanophenylacetic acid derivatives (such as ethyl α-cyano-2-methylphenylacetate and ethyl α-cyanophenylacetate), bis-o-naphthols [such as 2,2'-dihydroxyl-1-binaphthyl, 6,6'-dibromo-2,2'-dihydroxy-1,1'-binaphthyl, and bis(2-hydroxy-1-naphthyl)-methane], a combination of bis-o-naphthol and a 1,3-dihydroxybenzene derivative (for example, 2,4-dihydroxybenzophenone or 2,4-dihydroxyacetophenone), 5-pyrazolones such as 3-methyl-1-phenyl-5-pyrazolone, reductones (such as dimethylaminohexose reductone, anhydrodihydro-aminohexose reductone and anhydrodihydro-piperidone-hexose reductone), sulfonamidophenol reducing agents (such as 2,6-dichloro-4-benzenesulfonamido-phenol, and p-benzenesulfonamidophenol), indane-1,3-diones (such as 2-phenylindane-1,3-dione), chromans (such as 2,2-dimethyl-7-t-butyl-6-hydroxychroman), 1,4-dihydropyridines (such as 2,6-dimethoxy-3,5-dicarbethoxy-1,4-dihydropyridine), ascorbic acid derivatives (such as 1-ascorbylpalmitate, ascorbylstearate and unsaturated aldehydes and ketones), and 3-pyrazolidones.

An additional class of reducing agents that can be used as developers are substituted hydrazines including the sulfonyl hydrazides described in U.S. Pat. No. 5,464,738 (Lynch et al.). Still other useful reducing agents are described, for example, in U.S. Pat. No. 3,074,809 (Owen), U.S. Pat. No. 3,094,417 (Workman), U.S. Pat. No. 3,080,254 (Grant, Jr.), and U.S. Pat. No. 3,887,417 (Klein et al.). Auxiliary reducing agents may be useful as described in U.S. Pat. No. 5,981,151 (Leenders et al.). All of these patents are incorporated herein by reference.

Useful co-developer reducing agents can also be used as described for example, in U.S. Pat. No. 6,387,605 (Lynch et al.), that is incorporated herein by reference. Examples of these compounds include, but are not limited to, 2,5-dioxo-cyclopentane carboxaldehydes, 5-(hydroxymethylene)-2,2-dimethyl-1,3-dioxane-4,6-diones, 5-(hydroxymethylene)-1,3-dialkylbarbituric acids, and 2-(ethoxymethylene)-1H-indene-1,3 (2H)-diones.

Additional classes of reducing agents that can be used as co-developers are trityl hydrazides and formyl phenyl hydrazides as described in U.S. Pat. No. 5,496,695 (Simpson et al.), 2-substituted malondialdehyde compounds as described in U.S. Pat. No. 5,654,130 (Murray), and 4-substituted isoxazole compounds as described in U.S. Pat. No. 5,705,324 (Murray). Additional developers are described in U.S. Pat. No. 6,100,022 (Inoue et al.). All of the patents above are incorporated herein by reference.

Yet another class of co-developers includes substituted acrylonitrile compounds that are described in U.S. Pat. No. 5,635,339 (Murray) and U.S. Pat. No. 5,545,515 (Murray et al.), both incorporated herein by reference. Examples of such compounds include, but are not limited to, the compounds identified as HET-01 and HET-02 in U.S. Pat. No. 5,635,339 (noted above) and CN-01 through CN-13 in U.S. Pat. No. 5,545,515 (noted above). Particularly useful compounds of this type are (hydroxymethylene) cyanoacetates and their metal salts.

Various contrast enhancing agents can be used in some photothermographic materials with specific co-developers. Examples of useful contrast enhancing agents include, but are not limited to, hydroxylamines (including hydroxylamine and alkyl- and aryl-substituted derivatives thereof), alkanolamines and ammonium phthalamate compounds as described for example, in U.S. Pat. No. 5,545,505 (Simpson), hydroxamic acid compounds as described for example, in U.S. Pat. No. 5,545,507 (Simpson et al.), N-acylhydrazine compounds as described for example, in U.S. Pat. No. 5,558,983 (Simpson et al.), and hydrogen atom donor compounds as described in U.S. Pat. No. 5,637,449 (Harring et al.). All of the patents above are incorporated herein by reference.

When used with a silver carboxylate silver source in a thermographic material, preferred reducing agents are aromatic di- and tri-hydroxy compounds having at least two hydroxy groups in ortho- or para-relationship on the same aromatic nucleus. Examples are hydroquinone and substituted hydroquinones, catechols, pyrogallol, gallic acid and gallic acid esters (for example, methyl gallate, ethyl gallate, propyl gallate), and tannic acid.

Particularly preferred are reducing catechol-type reducing agents having no more than two hydroxy groups in an ortho-relationship. Preferred catechol-type reducing agents include, for example, catechol, 3-(3,4-dihydroxy-phenyl)-propionic acid, 2,3-dihydroxy-benzoic acid, 2,3-dihydroxy-benzoic acid esters, 3,4-dihydroxy-benzoic acid, and 3,4-dihydroxy-benzoic acid esters.

One particularly preferred class of catechol-type reducing agents are benzene compounds in which the benzene nucleus is substituted by no more than two hydroxy groups which are present in 2,3-position on the nucleus and have in the 1-position of the nucleus a substituent linked to the nucleus by means of a carbonyl group. Compounds of this type include 2,3-dihydroxy-benzoic acid, methyl 2,3-dihydroxy-benzoate, and ethyl 2,3-dihydroxy-benzoate.

Another particularly preferred class of catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group. Compounds of this type include, for example, 3,4-dihydroxy-benzoic acid, methyl 3,4-dihydroxy-benzoate, ethyl 3,4-dihydroxy-benzoate, 3,4-dihydroxy-benzaldehyde, and phenyl-(3,4-dihydroxyphenyl)ketone. Such compounds are described, for example, in U.S. Pat. No. 5,582,953 (Uyttendaele et al.).

Still another particularly useful class of reducing agents are polyhydroxy spiro-bis-indane compounds described as photographic tanning agents in U.S. Pat. No. 3,440,049 (Moede). Examples include 3,3,3',3'-tetramethyl-5,6,5',6'-tetrahydroxy-1,1'-spiro-bis-indane (called indane I) and 3,3,3',3'-tetramethyl-4,6,7,4',6',7'-hexahydroxy-1,1'-spiro-bis-indane (called indane II).

Aromatic di- and tri-hydroxy reducing agents can also be used in combination with hindered phenol reducing agents either together or in or in combination with one or more high contrast co-developing agents and co-developer contrast-enhancing agents).

The reducing agent (or mixture thereof) described herein is generally present as 1 to 10% (dry weight) of the emulsion layer. In multilayer constructions, if the reducing agent is added to a layer other than an emulsion layer, slightly higher proportions, of from about 2 to 15 weight % may be more desirable. Any co-developers may be present generally in an amount of from about 0.001% to about 1.5% (dry weight) of the emulsion layer coating.

For color imaging materials (for example, monochrome, dichrome, or full color images), one or more reducing agents can be used that can be oxidized directly or indirectly to form or release one or more dyes.

The dye-forming or releasing compound may be any colored, colorless, or lightly colored compound that can be oxidized to a colored form, or to release a preformed dye when heated, preferably to a temperature of from about 80° C. to about 250° C. for a duration of at least 1 second. When used with a dye- or image-receiving layer, the dye can diffuse through the imaging layers and interlayers into the image-receiving layer of the photothermographic material.

Leuco dyes or "blocked" leuco dyes are one class of dye-forming compounds (or "blocked" dye-forming compounds) that form and release a dye upon oxidation by silver ion to form a visible color image in the practice of the present invention. Leuco dyes are the reduced form of dyes that are generally colorless or very lightly colored in the visible region (optical density of less than 0.2). Thus, oxidation provides a color change that is from colorless to colored, an optical density increase of at least 0.2 units, or a substantial change in hue.

Representative classes of useful leuco dyes include, but are not limited to, chromogenic leuco dyes (such as indoaniline, indophenol, or azomethine dyes), imidazole leuco dyes such as 2-(3,5-di-t-butyl-4-hydroxyphenyl)-4,5-diphenylimidazole as described for example in U.S. Pat. No. 3,985,565 (Gabrielson et al.), dyes having an azine, diazine, oxazine, or thiazine nucleus such as those described for example in U.S. Pat. No. 4,563,415 (Brown et al.), U.S. Pat. No. 4,622,395 (Bellus et al.), U.S. Pat. No. 4,710,570 (Thien), and U.S. Pat. No. 4,782,010 (Mader et al.), and benzlidene leuco compounds as described for example in U.S. Pat. No. 4,932,792 (Grieve et al.), all incorporated herein by reference. Further details about the chromogenic leuco dyes noted above can be obtained from U.S. Pat. No. 5,491,059 (noted above, Column 13) and references noted therein.

Another useful class of leuco dyes includes what are known as "aldazine" and "ketazine" leuco dyes that are described for example in U.S. Pat. No. 4,587,211 (Ishida et al.) and U.S. Pat. No. 4,795,697 (Vogel et al.), both incorporated herein by reference.

Still another useful class of dye-releasing compounds includes those that release diffusible dyes upon oxidation. These are known as preformed dye release (PDR) or redox dye release (RDR) compounds. In such compounds, the reducing agents release a mobile preformed dye upon oxidation. Examples of such compounds are described in U.S. Pat. No. 4,981,775 (Swain), incorporated herein by reference.

Further, other useful image-forming compounds are those in which the mobility of a dye moiety changes as a result of an oxidation-reduction reaction with silver halide, or a nonphotosensitive silver salt at high temperature, as described for example in JP Kokai 165,054/84.

Still further, the reducing agent can be a compound that releases a conventional photographic dye forming color coupler or developer upon oxidation as is known in the photographic art.

The dyes that are formed or released can be the same in the same or different imaging layers. A difference of at least 60 nm in reflective maximum absorbance is preferred. More preferably, this difference is from about 80 to about 100 nm. Further details about the various dye absorbance are provided in U.S. Pat. No. 5,491,059 (noted above, Col. 14).

The total amount of one or more dye-forming or releasing compound that can be incorporated into the photothermographic materials of this invention is generally from about 0.5 to about 25 weight % of the total weight of each imaging layer in which they are located. Preferably, the amount in each imaging layer is from about 1 to about 10 weight %, based on the total dry layer weight. The useful relative proportions of the leuco dyes would be readily known to a skilled worker in the art.

Other Addenda

The thermographic and photothermographic materials of this invention can also contain other additives such as shelf-life stabilizers, antifoggants, contrast enhancers, development accelerators, acutance dyes, post-processing stabilizers or stabilizer precursors, thermal solvents (also known as melt formers), and other image-modifying agents as would be readily apparent to one skilled in the art.

To further control the properties of photothermographic materials, (for example, contrast, $D_{min}$, speed, or fog), it may be preferable to add one or more heteroaromatic mercapto compounds or heteroaromatic disulfide compounds of the formulae Ar—S—$M^1$ and Ar—S—S—Ar, wherein $M^1$ represents a hydrogen atom or an alkali metal atom and Ar represents a heteroaromatic ring or fused heteroaromatic ring containing one or more of nitrogen, sulfur, oxygen, selenium, or tellurium atoms. Preferably, the heteroaromatic ring comprises benzimidazole, naphthimidazole, benzothiazole, naphthothiazole, benzoxazole, naphthoxazole, benzoselenazole, benzotellurazole, imidazole, oxazole, pyrazole, triazole, thiazole, thiadiazole, tetrazole, triazine, pyrimidine, pyridazine, pyrazine, pyridine, purine, quinoline, or quinazolinone. Compounds having other heteroaromatic rings and compounds providing enhanced sensitization at other wavelengths are also envisioned to be suitable. For example, heteroaromatic mercapto compounds are described as supersensitizers for infrared photothermographic materials in EP 0 559 228B1 (Philip Jr. et al.).

The heteroaromatic ring may also carry substituents. Examples of preferred substituents are halo groups (such as bromo and chloro), hydroxy, amino, carboxy, alkyl groups (for example, of 1 or more carbon atoms and preferably 1 to 4 carbon atoms), and alkoxy groups (for example, of 1 or more carbon atoms and preferably of 1 to 4 carbon atoms).

Heteroaromatic mercapto compounds are most preferred. Examples of preferred heteroaromatic mercapto compounds are 2-mercaptobenzimidazole, 2-mercapto-5-methylbenzimidazole, 2-mercaptobenzothiazole and 2-mercaptobenzoxazole, and mixtures thereof.

If used, a heteroaromatic mercapto compound is generally present in an emulsion layer in an amount of at least about 0.0001 mole per mole of total silver in the emulsion layer. More preferably, the heteroaromatic mercapto compound is present within a range of about 0.001 mole to about 1.0 mole, and most preferably, about 0.005 mole to about 0.2 mole, per mole of total silver.

The photothermographic materials of the present invention can be further protected against the production of fog and can be stabilized against loss of sensitivity during storage. While not necessary for the practice of the invention, it may be advantageous to add mercury (2+) salts to the emulsion layer(s) as an antifoggant. Preferred mercury (2+) salts for this purpose are mercuric acetate and mercuric bromide. Other useful mercury salts include those described in U.S. Pat. No. 2,728,663 (Allen).

Other suitable antifoggants and stabilizers that can be used alone or in combination include thiazolium salts as described in U.S. Pat. No. 2,131,038 (Staud) and U.S. Pat. No. 2,694,716 (Allen), azaindenes as described in U.S. Pat. No. 2,886,437 (Piper), triazaindolizines as described in U.S. Pat. No. 2,444,605 (Heimbach), the urazoles described in U.S. Pat. No. 3,287,135 (Anderson), sulfocatechols as described in U.S. Pat. No. 3,235,652 (Kennard), the oximes described in GB 623,448 (Carrol et al.), polyvalent metal salts as described in U.S. Pat. No. 2,839,405 (Jones), thiuronium salts as described in U.S. Pat. No. 3,220,839 (Herz), palladium, platinum, and gold salts as described in U.S. Pat. No. 2,566,263 (Trirelli) and U.S. Pat. No. 2,597,915 (Damshroder), compounds having —$SO_2CBr_3$ groups as described for example in U.S. Pat. No. 5,594,143 (Kirk et al.) and U.S. Pat. No. 5,374,514 (Kirk et al.), and 2-(tribromomethylsulfonyl)quinoline compounds as described in U.S. Pat. No. 5,460,938 (Kirk et al.).

Stabilizer precursor compounds capable of releasing stabilizers upon application of heat during development can also be used. Such precursor compounds are described in for example, U.S. Pat. No. 5,158,866 (Simpson et al.), U.S. Pat. No. 5,175,081 (Krepski et al.), U.S. Pat. No. 5,298,390 (Sakizadeh et al.), and U.S. Pat. No. 5,300,420 (Kenney et al.).

In addition, certain substituted-sulfonyl derivatives of benzotriazoles (for example alkylsulfonylbenzotriazoles and arylsulfonylbenzotriazoles) have been found to be useful stabilizing compounds (such as for post-processing print stabilizing), as described in U.S. Pat. No. 6,171,767 (Kong et al.).

Furthermore, other specific useful antifoggants/stabilizers are described in more detail in U.S. Pat. No. 6,083,681 (Lynch et al.), incorporated herein by reference.

Other antifoggants are hydrobromic acid salts of heterocyclic compounds (such as pyridinium hydrobromide perbromide) as described, for example, in U.S. Pat. No. 5,028,523 (Skoug), benzoyl acid compounds as described, for example, in U.S. Pat. No. 4,784,939 (Pham), substituted propenenitrile compounds as described, for example, in U.S. Pat. No. 5,686,228 (Murray et al.), silyl blocked compounds as described, for example, in U.S. Pat. No. 5,358,843 (Sakizadeh et al.), vinyl sulfones as described, for example, in U.S. Pat. No. 6,143,487 (Philip, Jr. et al.), diisocyanate compounds as described, for example, in EP 0 600 586A1 (Philip, Jr. et al.), and tribromomethylketones as described, for example, in EP 0 600 587A1 (Oliff et al.).

Preferably, the photothermographic materials of this invention include one or more polyhalo antifoggants that include one or more polyhalo substituents including but not limited to, dichloro, dibromo, trichloro, and tribromo groups. The antifoggants can be aliphatic, alicyclic or aromatic compounds, including aromatic heterocyclic and carbocyclic compounds.

Particularly useful antifoggants are polyhalo antifoggants, such as those having a —$SO_2C(X')_3$ group wherein X' represents the same or different halogen atoms.

Advantageously, the photothermographic materials of this invention also include one or more thermal solvents (or melt formers). Representative examples of such compounds include, but are not limited to, salicylanilide, phthalimide, N-hydroxyphthalimide, N-potassium-phthalimide, succinimide, N-hydroxy-1,8-naphthalimide, phthalazine, 1-(2H)-phthalazinone, 2-acetylphthalazinone, benzanilide, dimethylurea, D-sorbitol, and benzene-sulfonamide. Combinations of these compounds can also be used including a combination of succinimide and dimethylurea. Known thermal solvents are disclosed, for example, in U.S. Pat. No. 3,438,776 (Yudelson), U.S. Pat. No. 5,250,386 (Aono et al.), U.S. Pat. No. 5,368,979 (Freedman et al.), U.S. Pat. No. 5,716,772 (Taguchi et al.), and U.S. Pat. No. 6,013,420 (Windender).

It is often advantageous to include a base-release agent or base precursor in the photothermographic materials according to the invention to provide improved and more effective image development. A base-release agent or base precursor as employed herein is intended to include compounds which upon heating in the photothermographic material provide a more effective reaction between the described photosensitive silver halide, and the image-forming combination comprising a silver salt and the silver halide developing agent. Representative base-release agents or base precursors include guanidinium compounds, such as guanidinium trichloroacetate, and other compounds that are known to release a base but do not adversely affect photographic silver halide materials, such as phenylsulfonyl acetates. Further details are provided in U.S. Pat. No. 4,123,274 (Knight et al.).

A range of concentration of the base-release agent or base precursor is useful in the described photothermographic materials. The optimum concentration of base-release agent or base precursor will depend upon such factors as the desired image, particular components in the photothermographic material, and processing conditions.

The use of "toners" or derivatives thereof that improve the image are highly desirable components of the thermographic and photothermographic materials of this invention. Toners are compounds that when added to the thermographic and photothermographic imaging layer shift the color of the developed silver image from yellowish-orange to brown-black or blue-black. Generally, one or more toners described herein are present in an amount of about 0.01% by weight to about 10%, and more preferably about 0.1% by weight to about 10% by weight, based on the total dry weight of the layer in which it is included. Toners may be incorporated in the photothermographic emulsion layer or in an adjacent layer.

Such compounds are well known materials in the photothermographic art, as shown in U.S. Pat. No. 3,080,254 (Grant, Jr.), U.S. Pat. No. 3,847,612 (Winslow), U.S. Pat. No. 4,123,282 (Winslow), U.S. Pat. No. 4,082,901 (Laridon et al.), U.S. Pat. No. 3,074,809 (Owen), U.S. Pat. No. 3,446,648 (Workman), U.S. Pat. No. 3,844,797 (Willems et al.), U.S. Pat. No. 3,951,660 (Hagemann et al.), U.S. Pat. No. 5,599,647 (Defieuw et al.) and GB 1,439,478 (AGFA).

Examples of toners include, but are not limited to, phthalimide and N-hydroxyphthalimide, cyclic imides (such as succinimide), pyrazoline-5-ones, quinazolinone, 1-phenylurazole, 3-phenyl-2-pyrazoline-5-one, and 2,4-thiazolidinedione, naphthalimides (such as N-hydroxy-1,8-naphthalimide), cobalt complexes [such as hexaaminecobalt (3+) trifluoroacetate], mercaptans (such as 3-mercapto-1,2,4-triazole, 2,4-dimercaptopyrimidine, 3-mercapto-4,5-diphenyl-1,2,4-triazole and 2,5-dimercapto-1,3,4-thiadiazole), N-(aminomethyl)aryldicarboximides (such as (N,N-dimethylaminomethyl)phthalimide), and N-(dimethylaminomethyl)naphthalene-2,3-dicarboximide, a combination of blocked pyrazoles, isothiuronium derivatives, and certain photobleach agents [such as a combination of N,N'-hexamethylene-bis(1-carbamoyl-3,5-dimethyl-pyrazole), 1,8-(3,6-diazaoctane)bis (isothiuronium)trifluoroacetate, and 2-(tribromomethylsulfonyl benzothiazole)], merocyanine dyes {such as 3-ethyl-5-[(3-ethyl-2-benzothiazolinylidene)-1-methylethylidene]-2-thio-2,4-o-azolidinedione}, phthalazine and derivatives thereof [such as those described in U.S. Pat. No. 6,146,822 (Asanuma et al.)], phthalazinone and phthalazinone derivatives, or metal salts or these derivatives [such as 4-(1-naphthyl)phthalazinone, 6-chlorophthalazinone, 5,7-dimethoxyphthalazinone, and 2,3-dihydro-1,4-phthalazinedione], a combination of phthalazine (or derivative thereof) plus one or more phthalic acid derivatives (such as phthalic acid, 4-methylphthalic acid, 4-nitrophthalic acid, and tetrachlorophthalic anhydride), quinazolinediones, benzoxazine or naphthoxazine derivatives, rhodium complexes functioning not only as tone modifiers but also as sources of halide ion for silver halide formation in-situ [such as ammonium hexachlororhodate (3+), rhodium bromide, rhodium nitrate, and potassium hexachlororhodate (3+)], benzoxazine-2,4-diones (such as 1,3-benzoxazine-2,4-dione, 8-methyl-1,3-benzoxazine-2,4-dione and 6-nitro-1,3-benzoxazine-2,4-dione), pyrimidines and asym-triazines (such as 2,4-dihydroxypyrimidine, 2-hydroxy-4-aminopyrimidine and azauracil) and tetraazapentalene derivatives [such as 3,6-dimercapto-1,4-diphenyl-1H,4H-2,3a,5,6a-tetraazapentalene and 1,4-di-(o-chlorophenyl)-3,6-dimercapto-1H,4H-2,3a,5,6a-tetraazapentalene].

Phthalazine and phthalazine derivatives [such as those described in U.S. Pat. No. 6,146,822 (noted above), incorporated herein by reference], phthalazinone, and phthalazinone derivatives are particularly useful toners.

Additional useful toners are substituted and unsubstituted mercaptotriazoles as described for example in U.S. Pat. No. 3,832,186 (Masuda et al.), U.S. Pat. No. 6,165,704 (Miyake et al.), U.S. Pat. No. 5,149,620 (Simpson et al.), and copending and commonly assigned U.S. Ser. No. 10/193,443 (filed Jul. 11, 2002 by Lynch, Zou, and Ulrich) and U.S. Ser. No. 10/192,944 (filed Jul. 11, 2002 by Lynch, Ulrich, and Zou), all of which are incorporated herein by reference.

The photothermographic materials of this invention can also include one or more image stabilizing compounds that are usually incorporated in a "backside" layer. Such compounds can include, but are not limited to, phthalazinone and its derivatives, pyridazine and its derivatives, benzoxazine and benzoxazine derivatives, benzothiazine dione and its derivatives, and quinazoline dione and its derivatives, particularly as described in copending and commonly assigned U.S. Ser. No. 10/041,386 (filed Jan. 8, 2002 by Kong). Other useful backside image stabilizers include, but are not limited to, anthracene compounds, coumarin compounds, benzophenone compounds, benzotriazole compounds, naphthalic acid imide compounds, pyrazoline compounds, or compounds described for example, in U.S. Pat. No. 6,465,162 (Kong et al.) and GB 1,565,043 (Fuji Photo). All of these patents and patent applications are incorporated herein by reference.

Binders

The photosensitive silver halide (when used), the non-photo-sensitive source of reducible silver ions, the reducing agent composition described above, and any other imaging layer additives used in the present invention are generally added to one or more binders that are either hydrophilic or hydrophobic. Thus, either aqueous or organic solvent-based formulations can be used to prepare the thermally developable materials of this invention. Mixtures of either or both types of binders can also be used. It is preferred that the binder be selected from hydrophobic polymeric materials such as, for example, natural and synthetic resins that are sufficiently polar to hold the other ingredients in solution or suspension.

Examples of typical hydrophobic binders include, but are not limited to, polyvinyl acetals, polyvinyl chloride, polyvinyl acetate, cellulose acetate, cellulose acetate butyrate, polyolefins, polyesters, polystyrenes, polyacrylonitrile, polycarbonates, methacrylate copolymers, maleic anhydride ester copolymers, butadiene-styrene copolymers, and other materials readily apparent to one skilled in the art. Copolymers (including terpolymers) are also included in the definition of polymers. The polyvinyl acetals (such as polyvinyl butyral and polyvinyl formal) and vinyl copolymers (such as polyvinyl acetate and polyvinyl chloride) are particularly preferred. Particularly suitable binders are polyvinyl butyral resins that are available as BUTVAR® B79 (Solutia, Inc.) and PIOLOFORM® BS-18 or PIOLOFORM® BL-16 (Wacker Chemical Company). Aqueous dispersions (or latexes) of hydrophobic binders may also be used.

Examples of useful hydrophilic binders include, but are not limited to, proteins and protein derivatives, gelatin and gelatin-like derivatives (hardened or unhardened, including alkali- and acid-treated gelatins, acetylated gelatin, oxidized gelatin, phthalated gelatin, and deionized gelatin), cellulosic materials such as hydroxymethyl cellulose and cellulosic esters, acrylamide/methacrylamide polymers, acrylic/methacrylic polymers polyvinyl pyrrolidones, polyvinyl alcohols, poly(vinyl lactams), polymers of sulfoalkyl acrylate or methacrylates, hydrolyzed polyvinyl acetates, polyacrylamides, polysaccharides (such as dextrans and starch ethers), and other synthetic or naturally occurring vehicles commonly known for use in aqueous-based photographic emulsions (see for example, *Research Disclosure*, item 38957, noted above). Cationic starches can be used as a peptizer for tabular silver halide grains as described in U.S. Pat. No. 5,620,840 (Maskasky) and U.S. Pat. No. 5,667,955 (Maskasky).

Hardeners for various binders may be present if desired. Useful hardeners are well known and include diisocyanate compounds as described for example, in EP 0 600 586 B1 (Philip, Jr. et al.) and vinyl sulfone compounds as described in U.S. Pat. No. 6,143,487 (Philip, Jr. et al.), and EP 0 640 589 (Gathmann et al.), aldehydes and various other hardeners as described in U.S. Pat. No. 6,190,822 (Dickerson et al.). The hydrophilic binders used in the photothermographic materials are generally partially or fully hardened using any conventional hardener. Useful hardeners are well known and are described, for example, in T. H. James, *The Theory of the Photographic Process*, Fourth Edition, Eastman Kodak Company, Rochester, N.Y., 1977, Chapter 2, pp. 77–8.

Where the proportions and activities of the thermographic and photothermographic materials require a particular developing time and temperature, the binder(s) should be able to withstand those conditions. When a hydrophobic binder is used, it is preferred that the binder does not decompose or lose its structural integrity at 120° C. for 60 seconds. When a hydrophilic binder is used, it is preferred that the binder does not decompose or lose its structural integrity at 150° C. for 60 seconds. It is more preferred that it does not decompose or lose its structural integrity at 177° C. for 60 seconds.

The polymer binder(s) is used in an amount sufficient to carry the components dispersed therein. The effective range of amount of polymer can be appropriately determined by one skilled in the art. Preferably, a binder is used at a level of about 10% by weight to about 90% by weight, and more preferably at a level of about 20% by weight to about 70% by weight, based on the total dry weight of the layer in which it is included.

It is particularly useful in the thermally developable materials of this invention to use predominantly (more than 50% by weight of total binder weight) hydrophobic binders in both imaging and non-imaging layers on both sides of the support. In particular, the backside antistatic layers described in more detail below are formulated and disposed on the support with one or more hydrophobic binders such as cellulose ester binders. Of these binders, cellulose acetate, cellulose acetate butyrate, and cellulose acetate propionate are preferred. Cellulose acetate butyrate is more preferred as the predominant binder for the conductive antistatic layers. In most preferred embodiments, cellulose acetate butyrate is the only binder in the conductive antistatic layers.

Support Materials

The thermally developable materials of this invention comprise a polymeric support that is preferably a flexible, transparent film that has any desired thickness and is composed of one or more polymeric materials, depending upon their use. The supports are generally transparent (especially if the material is used as a photomask) or at least translucent, but in some instances, opaque supports may be useful. They are required to exhibit dimensional stability during thermal development and to have suitable adhesive properties with overlying layers. Useful polymeric materials for making such supports include, but are not limited to, polyesters (such as polyethylene terephthalate and polyethylene naphthalate), cellulose acetate and other cellulose esters, polyvinyl acetal, polyolefins (such as polyethylene and polypropylene), polycarbonates, and polystyrenes (and polymers of styrene derivatives). Preferred supports are composed of polymers having good heat stability, such as polyesters and polycarbonates. Polyethylene terephthalate film is a particularly preferred support. Various support materials are described, for example, in *Research Disclosure*, August 1979, item 18431. A method of making dimensionally stable polyester films is described in *Research Disclosure*, September 1999, item 42536.

It is also useful to use supports comprising dichroic mirror layers wherein the dichroic mirror layer reflects radiation at least having the predetermined range of wavelengths to the emulsion layer and transmits radiation having wavelengths outside the predetermined range of wavelengths. Such dichroic supports are described in U.S. Pat. No. 5,795,708 (Boutet), incorporated herein by reference.

It is further useful to use transparent, multilayer, polymeric supports comprising numerous alternating layers of at least two different polymeric materials. Such multilayer polymeric supports preferably reflect at least 50% of actinic radiation in the range of wavelengths to which the photothermographic sensitive material is sensitive, and provide photothermographic materials having increased speed. Such transparent, multilayer, polymeric supports are described in WO 02/21208 (Simpson et al.), incorporated herein by reference.

Opaque supports can also be used, such as dyed polymeric films and resin-coated papers that are stable to high temperatures.

Support materials can contain various colorants, pigments, antihalation or acutance dyes if desired. Support materials may be treated using conventional procedures (such as corona discharge) to improve adhesion of overlying layers, or subbing or other adhesion-promoting layers can be used. Useful subbing layer formulations include those conventionally used for photographic materials such as vinylidene halide polymers.

Support materials may also be treated or annealed to reduce shrinkage and promote dimensional stability.

Photothermographic Formulations

An organic-based formulation for the thermographic and photothermographic emulsion layer(s) can be prepared by dissolving and dispersing the binder, the photocatalyst (when used), the source of non-photosensitive silver ions, the reducing composition, toner(s), and optional addenda in an organic solvent, such as toluene, 2-butanone (methyl ethyl ketone), acetone, or tetrahydrofuran.

Alternatively, the desired imaging components can be formulated with a hydrophilic binder (such as gelatin, a gelatin-derivative, or a latex) in water or water-organic solvent mixtures to provide aqueous-based coating formulations.

Thermographic and photothermographic materials of the invention can contain plasticizers and lubricants such as poly(alcohols) and diols of the type described in U.S. Pat. No. 2,960,404 (Milton et al.), fatty acids or esters such as those described in U.S. Pat. No. 2,588,765 (Robijns) and U.S. Pat. No. 3,121,060 (Duane), and silicone resins such as those described in GB 955,061 (DuPont). The materials can also contain matting agents such as starch, titanium dioxide, zinc oxide, silica, and polymeric beads including beads of the type described in U.S. Pat. No. 2,992,101 (Jelley et al.) and U.S. Pat. No. 2,701,245 (Lynn). Polymeric fluorinated surfactants may also be useful in one or more layers of the imaging materials for various purposes, such as improving coatability and optical density uniformity as described in U.S. Pat. No. 5,468,603 (Kub).

U.S. Pat. No. 6,436,616 (Geisler et al.) describes various means of modifying photothermographic materials to reduce what is known as the "woodgrain" effect, or uneven optical density. This effect can be reduced or eliminated by several means, including treatment of the support, adding matting agents to the topcoat, using acutance dyes in certain layers or other procedures described in the noted publication.

The thermographic and photothermographic materials of this invention can be constructed of one or more layers on the imaging side of the support. Single layer materials should contain the photocatalyst, the non-photosensitive source of reducible silver ions, the reducing agent composition, the binder, as well as optional materials such as toners, acutance dyes, coating aids, and other adjuvants.

Two-layer constructions comprising a single imaging layer coating containing all the ingredients and a surface protective topcoat are generally found on the frontside of the materials of this invention. However, two-layer constructions containing photocatalyst and non-photosensitive source of reducible silver ions in one imaging layer (usually the layer adjacent to the support) and the reducing composition and other ingredients in the second imaging layer or distributed between both layers are also envisioned.

Layers to promote adhesion of one layer to another in thermographic and photothermographic materials are also known, as described for example in U.S. Pat. No. 5,891,610 (Bauer et al.), U.S. Pat. No. 5,804,365 (Bauer et al.), and U.S. Pat. No. 4,741,992 (Przezdziecki). Adhesion can also be promoted using specific polymeric adhesive materials as described for example in U.S. Pat. No. 5,928,857 (Geisler et al.).

Layers to reduce emissions from the film may also be present, including the polymeric barrier layers described in U.S. Pat. No. 6,352,819 (Kenney et al.), U.S. Pat. No. 6,352,820 (Bauer et al.), and U.S. Pat. No. 6,420,102B1 (Bauer et al.), all incorporated herein by reference.

Thermographic and photothermographic formulations described herein can be coated by various coating procedures including wire wound rod coating, dip coating, air knife coating, curtain coating, slide coating, or extrusion coating using hoppers of the type described in U.S. Pat. No. 2,681,294 (Beguin). Layers can be coated one at a time, or two or more layers can be coated simultaneously by the procedures described in U.S. Pat. No. 2,761,791 (Russell), U.S. Pat. No. 4,001,024 (Dittman et al.), U.S. Pat. No. 4,569,863 (Keopke et al.), U.S. Pat. No. 5,340,613 (Hanzalik et al.), U.S. Pat. No. 5,405,740 (LaBelle), U.S. Pat. No. 5,415,993 (Hanzalik et al.), U.S. Pat. No. 5,525,376 (Leonard), U.S. Pat. No. 5,733,608 (Kessel et al.), U.S. Pat. No. 5,849,363 (Yapel et al.), U.S. Pat. No. 5,843,530 (Jerry et al.), U.S. Pat. No. 5,861,195 (Bhave et al.), and GB 837,095 (Ilford). A typical coating gap for the emulsion layer can be from about 10 to about 750 $\mu$m, and the layer can be dried in forced air at a temperature of from about 20° C. to about 100° C. It is preferred that the thickness of the layer be selected to provide maximum image densities greater than about 0.2, and more preferably, from about 0.5 to 5.0 or more, as measured by a MacBeth Color Densitometer Model TD 504.

When the layers are coated simultaneously using various coating techniques, a "carrier" layer formulation comprising a single-phase mixture of the two or more polymers described above may be used. Such formulations are described in U.S. Pat. No. 6,355,405 (Ludemann et al.), incorporated herein by reference.

Mottle and other surface anomalies can be reduced in the materials of this invention by incorporation of a fluorinated polymer as described for example in U.S. Pat. No. 5,532,121 (Yonkoski et al.) or by using particular drying techniques as described, for example in U.S. Pat. No. 5,621,983 (Ludemann et al.).

Preferably, two or more layers are applied to a film support using slide coating. The first layer can be coated on top of the second layer while the second layer is still wet. The first and second fluids used to coat these layers can be the same or different solvents (or solvent mixtures).

While the first and second layers can be coated on one side of the film support, manufacturing methods can also include forming on the opposing or backside of said polymeric support, one or more additional layers, including the required conductive layer, and optionally an antihalation layer or a layer containing a matting agent (such as silica), or a combination of such layers.

It is also contemplated that the photothermographic materials of this invention can include emulsion layers on both sides of the support and at least one infrared radiation absorbing heat-bleachable compositions as an antihalation underlayer beneath at least one emulsion layer.

To promote image sharpness, photothermographic materials according to the present invention can contain one or more layers containing acutance and/or antihalation dyes. These dyes are chosen to have absorption close to the exposure wavelength and are designed to absorb scattered light. One or more antihalation compositions may be incorporated into one or more antihalation layers according to known techniques, as an antihalation backing layer, as an antihalation underlayer, or as an antihalation overcoat. Additionally, one or more acutance dyes may be incorporated into one or more frontside layers such as the photothermographic emulsion layer, primer layer, underlayer, or topcoat layer according to known techniques. It is preferred that the photothermographic materials of this invention contain an antihalation composition on the backside of the support, and more preferably in the backside conductive layer.

Dyes useful as antihalation and acutance dyes include squaraine dyes described in U.S. Pat. No. 5,380,635 (Gomez et al.), U.S. Pat. No. 6,063,560 (Suzuki et al.), and EP 1 083 459A1 (Kimura), the indolenine dyes described in EP 0 342 810A1 (Leichter), and the cyanine dyes described in copending and commonly assigned U.S. Ser. No. 10/011,892 (filed Dec. 5, 2001 by Hunt, Kong, Ramsden, and LaBelle). All of the above references are incorporated herein by reference.

It is also useful in the present invention to employ compositions including acutance or antihalation dyes that will decolorize or bleach with heat during processing. Dyes and constructions employing these types of dyes are described in, for example, U.S. Pat. No. 5,135,842 (Kitchin et al.), U.S. Pat. No. 5,266,452 (Kitchin et al.), U.S. Pat. No. 5,314,795 (Helland et al.), U.S. Pat. No. 6,306,566, (Sakurada et al.), U.S. Published Application 2001-0001704 (Sakurada et al.), J P Kokai 2001-142175 (Hanyu et al.), and J P Kokai 2001-183770 (Hanye et al.). Also useful are bleaching compositions described in J P Kokai 11-302550 (Fujiwara), J P Kokai 2001-109101 (Adachi), J P Kokai 2001-51371 (Yabuki et al.), and J P Kokai 2000-029168 (Noro). All of the above publications are incorporated herein by reference.

Particularly useful heat-bleachable backside antihalation compositions can include an infrared radiation absorbing compound such as an oxonol dyes and various other compounds used in combination with a hexaarylbiimidazole (also known as a "HABI"), or mixtures thereof. Such HABI compounds are well known in the art, such as U.S. Pat. No. 4,196,002 (Levinson et al.), U.S. Pat. No. 5,652,091 (Perry et al.), and U.S. Pat. No. 5,672,562 (Perry et al.), all incorporated herein by reference. Examples of such heat-bleachable compositions are described for example in U.S. Pat. Nos. 6,455,210 and 6,558,880 (Goswami et al.) and 6,514,677 (Ramsden et al.), all incorporated herein by reference.

Under practical conditions of use, the compositions are heated to provide bleaching at a temperature of at least 90° C. for at least 0.5 seconds. Preferably, bleaching is carried out at a temperature of from about 100° C. to about 200° C. for from about 5 to about 20 seconds. Most preferred bleaching is carried out within 20 seconds at a temperature of from about 110° C. to about 130° C.

In preferred embodiments, the thermally developable materials of this invention include a surface protective layer on the same side of the support as the one or more thermally-developable layers and a conductive layer on the back side of the support that can also include an antihalation composition. A backside surface protective layer can also be included in these embodiments.

Antistatic Compositions/Layers

The essential feature of the present invention is the presence of at least one conductive layer on the backside (non-imaging side) of the support that includes one or more specific nonpolymeric fluorochemicals as antistatic agents. These nonpolymeric fluorochemicals are represented by the following Structure I:

$$R_f—R—N(R_1)(R_2)(R_3)^+X^- \quad (I)$$

wherein $R_f$ is a straight or branched chain perfluoroalkyl group having 4 to 18 partially or fully fluorinated carbon atoms. In preferred embodiments, $R_f$ comprises a perfluoroalkyl chain comprising 6 to 12 fully fluorinated carbon atoms (that is, every hydrogen atom attached to a carbon atom in the chain has been replaced by a fluorine atom). However, substituents on the various alkyl chains can be partially or fully fluorinated.

R is a divalent straight or branched linking group comprising at 4 to 10 carbon atoms and a sulfide group in the chain. Preferably, R comprises at 4 to 8 carbon atoms in the chain. This linking group can be substituted with one or more substituents such as hydroxy, thio, alkoxy, thioalkoxy, acetoxy, and carboxy groups. Preferably, at least one hydroxy group is present on the linking group.

In preferred embodiments, R can be represented by $—R_a—S—R_b—$ wherein $R_a$ and $R_b$ are independently substituted or unsubstituted alkylene groups having 1 to 10 carbon atoms in the chain. Preferably $R_a$ and $R_b$ each independently have 2 to 4 carbon atoms in the chain.

$R_1$, $R_2$, $R_3$ are independently hydrogen or substituted or unsubstituted, straight or branched alkyl groups having 1 to 10 carbon atoms (preferably from 1 to 4 carbon atoms). Alternatively, any two of $R_1$, $R_2$, and $R_3$ taken together can represent the carbon and nitrogen atoms necessary to provide a 5- to 7-membered heterocyclic ring with the cationic nitrogen atom (thus forming a pyrrolidinium, piperdinium, or azepanium ring).

In preferred embodiments, $R_1$, $R_2$, and $R_3$ are independently hydrogen or unsubstituted, straight or branched alkyl groups having 1 to 4 carbon atoms. More preferably $R_1$, $R_2$, $R_3$ are each methyl groups.

$X^-$ is a monovalent anion, such as a halide (for example, fluoride or chloride), tetrafluoroborate, perchlorate, antimonate, methylsulfonate, or p-toluenesulfonate. Halides are preferred.

By "nonpolymeric" is meant that the fluorochemicals useful in the practice of this invention have a molecular weight up to 3000 and preferably a molecular weight of from about 500 to about 1500.

Some particularly useful nonpolymeric fluorochemicals are compounds represented by Structure I-1 below wherein $R_f$ comprises 6 to 12 fully fluorinated carbon atoms:

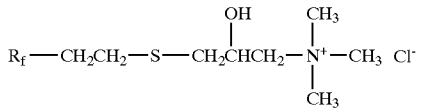

(I-1)

Compounds of Structure I-1 are most preferred and can be supplied as the "active" components in ZONYL® FSD surfactant from DuPont. Compounds of Structure I-1 are also available as the "active" components in LODYNE® S-106A surfactant from Ciba.

The nonpolymeric fluorochemicals useful in the present invention are present in a dried backside layer formulation an amount sufficient to provide a backside surface resistivity measured at 25° C. and 20% relative humidity of $4\times10^{11}$ ohms or less. Surface resistivity can be measured using conventional techniques and equipment (as shown for example prior to the examples below). Generally, this means that the one or more fluorochemicals (active component if in solution) are present in an amount of from about 0.011 to about 0.021 g/m$^2$. There can be multiple conductive layers on the backside of the support but in preferred embodiments, there is a single conductive layer that also performs other useful functions such as antihalation and surface protection.

The thermally developable materials of this invention can also include one or more antistatic or conducting layers on the frontside of the support. Such layers may contain conventional antistatic agents known in the art for this purpose such as soluble salts (for example, chlorides or nitrates), evaporated metal layers, or ionic polymers such as those described in U.S. Pat. No. 2,861,056 (Minsk) and U.S. Pat. No. 3,206,312 (Sterman et al.), or insoluble inorganic salts such as those described in U.S. Pat. No. 3,428,451 (Trevoy), electroconductive underlayers such as those described in U.S. Pat. No. 5,310,640 (Markin et al.), electronically-conductive metal antimonate particles such as those described in U.S. Pat. No. 5,368,995 (Christian et al.), and electrically-conductive metal-containing particles dispersed in a polymeric binder such as those described in EP 0 678 776A1 (Melpolder et al.).

In some embodiments, a frontside conductive layer may also include the same or different one or more nonpolymeric fluorochemicals defined by Structure I noted above. The presence of such frontside conductive layers should not have any adverse effects on the sensitometric properties of the thermographic or photothermographic material.

The nonpolymeric fluorochemicals may be formulated into antistatic compositions using one or more solvents, at least 50 volume % being composed of one or more organic solvents such as methyl ethyl ketone (2-butanone, or "MEK"), methyl iso-butyl ketone ("MIBK"), tetrahydrofuran, acetone, ethanol, methanol, ethyl acetate, and mixtures of two or more of these solvents. MEK and methanol are the most preferred solvents. Some water may be present with organic solvents that are water-miscible.

The one or more fluorochemicals are present in the noted solvents in an amount of from about 0.2 to about 1.0 weight % and preferably at from about 0.3 to about 0.5 weight % of active ingredients.

Preferably, the backside conductive layers include one or more hydrophobic binders. Numerous examples are described above in the "Binder" section of this specification. Also as noted above, preferred hydrophobic binders include cellulose acetate binders such as cellulose acetate and cellulose acetate butyrate especially when the support is a transparent polyester film. The amount of binder(s) in the conductive layer is generally a function of the viscosity required by the coating method used. For example, when the preferred cellulose acetate butyrate is used as a binder, it is generally present in the layer coating formulation in an amount of from about 10 to about 12 weight % and preferably from about 10.5 to about 11.5 weight % is useful.

In preferred thermographic and photothermographic materials of this invention, the weight ratio of fluorochemical to binder (such as a cellulose ester) in the conductive layers is from about 0.018:1 to about 0.055:1.

The conductive layer may also include other addenda commonly added to such formulations including, but not limited to, shelf life extenders, acutance dyes, colorants to control tint and tone, UV absorbing materials, to improve light-box stability, and coating aids such as surfactants to achieve high quality coatings, all in conventional amounts. It is also useful to add inorganic matting agents such as the polysilicic acid particles as described in U.S. Pat. No. 4,828,971 (Przezdziecki), poly(methyl methacrylate) beads as described in U.S. Pat. No. 5,310,640 (Markin et al.), or polymeric cores surrounded by a layer of colloidal inorganic particles as described in U.S. Pat. No. 5,750,328 (Melpolder et al.).

Preferably, the backside conductive layer further comprises an antihalation composition. One particularly useful antihalation composition is a squaraine dye such as Backcoat Dye BC-1 identified below in the examples. Heat-bleachable antihalation compositions as described above can also be used.

In some embodiments, a protective layer is disposed over the backside conductive layer. In preferred embodiments, the support is a transparent polyester film and the backside conductive layer comprises a cellulose ester binder.

Imaging/Development

The thermally developable materials of the present invention can be imaged in any suitable manner consistent with the type of material using any suitable imaging source (typically some type of radiation or electronic signal for photothermographic materials and a source of thermal energy for thermographic materials). In some embodiments, the materials are sensitive to radiation in the range of from about at least 300 nm to about 1400 nm, and preferably from about 300 nm to about 850 nm.

Imaging can be achieved by exposing the photothermographic materials of this invention to a suitable source of radiation to which they are sensitive, including ultraviolet radiation, visible light, near infrared radiation and infrared radiation to provide a latent image. Suitable exposure means are well known and include sources of radiation, including: incandescent or fluorescent lamps, xenon flash lamps, lasers, laser diodes, light emitting diodes, infrared lasers, infrared laser diodes, infrared light-emitting diodes, infrared lamps, or any other ultraviolet, visible, or infrared radiation source readily apparent to one skilled in the art, and others described in the art, such as in *Research Disclosure*, September, 1996, item 38957. Particularly useful infrared exposure means include laser diodes, including laser diodes that are modulated to increase imaging efficiency using what is known as multi-longitudinal exposure techniques as described in U.S. Pat. No. 5,780,207 (Mohapatra et al.). Other exposure techniques are described in U.S. Pat. No. 5,493,327 (McCallum et al.).

Thermal development conditions will vary, depending on the construction used but will typically involve heating the imagewise exposed material at a suitably elevated temperature. Thus, the latent image can be developed by heating the exposed material at a moderately elevated temperature of, for example, from about 50° C. to about 250° C. (preferably from about 80° C. to about 200° C. and more preferably from about 100° C. to about 200° C.) for a sufficient period of time, generally from about 1 to about 120 seconds. Heating can be accomplished using any suitable heating means such as a hot plate, a steam iron, a hot roller or a heating bath.

In some methods, the development is carried out in two steps. Thermal development takes place at a higher temperature for a shorter time (for example at about 150° C. for up to 10 seconds), followed by thermal diffusion at a lower temperature (for example at about 80° C.) in the presence of a transfer solvent.

When imaging thermographic materials of this invention, the image may be "written" simultaneously with development at a suitable temperature using a thermal stylus, a thermal print head or a laser, or by heating while in contact with a heat-absorbing material. The thermographic materials may include a dye (such as an IR-absorbing dye) to facilitate direct development by exposure to laser radiation. The dye converts absorbed radiation to heat.

Use as a Photomask

The thermographic and photothermographic materials of the present invention are sufficiently transmissive in the range of from about 350 to about 450 nm in non-imaged areas to allow their use in a method where there is a subsequent exposure of an ultraviolet or short wavelength visible radiation sensitive imageable medium. For example, imaging the materials and subsequent development affords a visible image. The heat-developed thermographic and photothermographic materials absorbs ultraviolet or short wavelength visible radiation in the areas where there is a visible image and transmit ultraviolet or short wavelength visible radiation where there is no visible image. The heat-developed materials may then be used as a mask and positioned between a source of imaging radiation (such as an ultraviolet or short wavelength visible radiation energy source) and an imageable material that is sensitive to such imaging radiation, such as a photopolymer, diazo material, photoresist, or photosensitive printing plate. Exposing the imageable material to the imaging radiation through the visible image in the exposed and heat-developed photothermographic material provides an image in the imageable material. This method is particularly useful where the imageable medium comprises a printing plate and the photothermographic material serves as an imagesetting film.

The present invention also provides a method for the formation of a visible image (usually a black-and-white image) by first exposing to electromagnetic radiation and thereafter heating the inventive photothermographic material. In one embodiment, the present invention provides a method comprising:

A) imagewise exposing the photothermographic material of this invention to electromagnetic radiation to which the photocatalyst (for example, a photosensitive silver halide) of the material is sensitive, to form a latent image, and B) simultaneously or sequentially, heating the exposed material to develop the latent image into a visible image.

The photothermographic material may be exposed in step A using any source of radiation, to which it is sensitive, including: ultraviolet radiation, visible light, infrared radiation or any other infrared radiation source readily apparent to one skilled in the art.

The present invention also provides a method for the formation of a visible image (usually a black-and-white image) by thermal imaging of the inventive thermographic material. In one embodiment, the present invention provides a method comprising:

A) thermal imaging of the thermographic material of this invention to form a visible image.

This visible image prepared from either a thermographic or photothermographic material can also be used as a mask for exposure of other photosensitive imageable materials, such as graphic arts films, proofing films, printing plates and circuit board films, that are sensitive to suitable imaging radiation (for example, UV radiation). This can be done by imaging an imageable material (such as a photopolymer, a diazo material, a photoresist, or a photosensitive printing plate) through the heat-developed thermographic or photothermographic material. Thus, in some other embodiments wherein the thermographic or photothermographic material comprises a transparent support, the image-forming method further comprises:

C) positioning the exposed and heat-developed thermographic or photothermographic material between a source of imaging radiation and an imageable material that is sensitive to the imaging radiation, and D) exposing the imageable material to the imaging radiation through the visible image in the exposed and heat-developed photothermographic material to provide an image in the imageable material.

The following examples are provided to illustrate the practice of the present invention and the invention is not meant to be limited thereby.

MATERIALS AND METHODS FOR THE EXPERIMENTS AND EXAMPLES

All materials used in the following examples are readily available from standard commercial sources, such as Aldrich Chemical Co. (Milwaukee Wis.) unless otherwise specified. All percentages are by weight unless otherwise indicated. The following additional terms and materials were used.

ACRYLOID® A-21 is an acrylic copolymer available from Rohm and Haas (Philadelphia, Pa.).

ALBACAR 5970 is a 1.9 $\mu$m precipitated calcium carbonate. It is available from Specialty Minerals, Inc. (Bethlehem, Pa.).

BUTVAR® B-79 is a polyvinyl butyral resin available from Solutia, Inc. (St. Louis, Mo.).

CAB 171-15S and CAB 381-20 are cellulose acetate butyrate resins available from Eastman Chemical Co. (Kingsport, Tenn.).

PERMANAX WSO (or NONOX®) is 1,1-bis(2-hydroxy-3,5-dimethylphenyl)-3,5,5-trimethylhexane [CAS RN=7292-14-0] and is available from St-Jean PhotoChemicals, Inc. (Quebec, Canada).

MEK is methyl ethyl ketone (or 2-butanone).

PIOLOFORM® BL-16 and PIOLOFORM® BN-18 are polyvinyl butyral resins available from Wacker Polymer Systems (Adrian, Mich.).

SERVOXYL® VPAZ 100 is a mixture of monolauryl and dilauryl esters of phosphoric acid. It is available from Sasol North America (Houston, Tex.).

VITEL® PE-2200 is a polyester resin available from Bostik, Inc. (Middleton, Mass.).

Backcoat Dye BC-1 is cyclobutenediylium, 1,3-bis[2,3-dihydro-2,2-bis[[1-oxohexyl)oxy]methyl]-1H-perimidin-4-yl]-2,4-dihydroxy-, bis(inner salt). It is believed to have the structure shown below.

BC-1

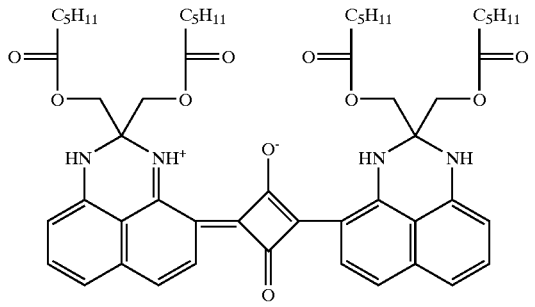

ASA-11 is the trifluoromethanesulfonate salt of hydrogenated tallowalkyldimethylamines (ARMEEN DMHTD). The tallowalkyldimethylamine (ARMEEN DMHTD) is available from Akzo Nobel (Burt, N.Y.). It was prepared by addition of the amine to a flask containing a MEK solution of trifulormethane sulfonic acid. The reaction mixture was cooled during the addition and the pH was monitored. The reaction terminated at pH 7. The viscous solution was used without further purification.

ASA-12 is the trifluoromethane sulfonate salt of Jeffamine® ED600. Jeffamine® ED600 is available from Huntsman Corporation (Houston, Tex.). It was prepared by addition of the amine to a flask containing a MEK solution of trifulormethane sulfonic acid. The reaction mixture was cooled during the addition and the pH was monitored. The reaction terminated at pH 7. The viscous solution was used without further purification.

ASA-13 is the trifluoromethane sulfonate salt of Jeffamine® ED900. Jeffamine® ED900 is available from Huntsman Corporation (Houston, Tex.) was prepared by addition of the amine to a flask containing a MEK solution of trifulormethane sulfonic acid. The reaction mixture was cooled during the addition and the pH was monitored. The reaction terminated at pH 7. The viscous solution was used without further purification.

AVITEX® DN-100 is a cationic fluorosurfactant and is available from DuPont (Wilmington, Del.).

FLUOROLINK XPH 613 is the lithium salt of a dicarboxy derivative of a perfluoropolyoxyalkane (20–25% wt) in isopropyl alcohol (1–2% wt) and water (75–80% wt). It is available from Ausimont USA, Inc. (Thorofare, N.J.).

FLUOROLINK XPH 614 is the lithium salt of a perfluoropolyether derivative (20–25% wt) in isopropyl alcohol (1–2% wt) and water (75–80% wt). It is available from Ausimont USA, Inc. (Thorofare, N.J.).

FLUOROLINK XPH 615 is the sodium salt of a dicarboxy derivative of a perfluoropolyoxyalkane (20–25% wt) in isopropyl alcohol (1–2% wt) and water (75–80% wt). It is available from Ausimont USA, Inc. (Thorofare, N.J.).

FLUOROLINK XPH 616 is the sodium salt of a perfluoropolyether derivative (20–25% wt) in isopropyl alcohol (1–2% wt) and water (75–80% wt). It is available from Ausimont USA, Inc. (Thorofare, N.J.).

FLOWET® NMQ is available from Clariant Corporation (Switzerland)

LODYNE® S100 is a solution of a mixture of fluoroalkylamino-carboxylic acids. It is an amphoteric surfactant available from Ciba Specialty Chemicals Corporation (High Point, N.C.) and is believed to have the following formula

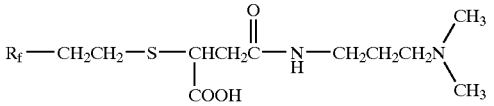

and

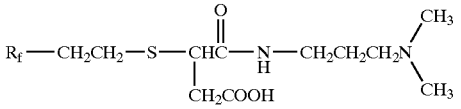

wherein $R_f$ is $CF_3CF_2(CF_2CF_2)_z$ and z is 2 to 4.

LODYNE® S103A is a fluoroalkyl sodium sulfate anionic surfactant available from Ciba Specialty Chemicals Corporation (High Point, N.C.). It is believed to have the following formula

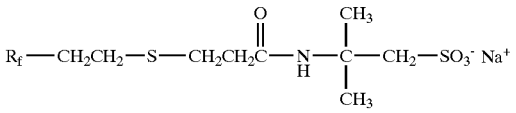

wherein $R_f$ is $CF_3CF_2(CF_2CF_2)_z$ and z is 2 to 4. It available from Ciba Specialty Chemicals Corporation (High Point, N.C.).

LODYNE® S106A is a cationic fluorosurfactant and is believed to have the following formula as disclosed in U.S. Pat. No. 5,229,480 (Uschold)

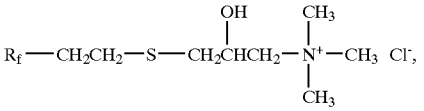

where $R_f$ is $CF_3CF_2(CF_2CF_2)_z$ and z is 2 in at least 95% of the compound and z is 3 in less that 5% of the compound. It available from Ciba Specialty Chemicals Corporation (High Point, N.C.).

L-9342 is a perfluorinated organic antistatic agent described as Compound 1 of U.S. Pat. No. 4,975,363 (Cavallo et al.). It is available from 3M Company (St. Paul, Minn.).

MODIPER® F-600 is believed to be an acrylic block copolymer having a "fluoric segment." It is available from NOF America Corporation (New York).

MODIPER® FS-700 is believed to be an acrylic block copolymer having a "fluoric/silicone" segment. It is available from NOF America Corporation (New York).

POLYFOX™ is a fluorosurfactant that is available from Omnova (Fairlawn, Ohio).

SURFLON® S393 is a fluoropolymer that is available from Seimi Chemicals Co. (Chigasaki City, Japan).

SURFLON® S8405 is a fluoropolymer that is available from Seimi Chemicals Co. (Chigasaki City, Japan).

SURFONIC® PE-BP2 is a phosphated alcohol (alkyl phosphate ester). It is an anionic surfactant that is available from Huntsman Corporation (Houston, Tex.).

Syloid 74X6000 is a synthetic amorphous silica that is available from Grace-Davison (Columbia, Md.).

ZONYL® BA is believed to have the formula $R_fCH_2CH_2OH$, where $R_f$ is $CF_3CF_2(CF_2CF_2)_z$ where z is 2 to 4. It is available from DuPont (Wilmington, Del.).

ZONYL® FSA is an anionic fluorosurfactant and is believed to have the formula $R_fCH_2CH_2SCH_2CH_2COO\ Li^+$ where $R_f$ is $CF_3CF_2(CF_2CF_2CF_2)_z$ and z is 2 to 4. It is available from DuPont (Wilmington, Del.).

ZONYL® FSD is a cationic fluorosurfactant from DuPont (Wilmington, Del.). It is believed to have the following structure as disclosed in U.S. Pat. No. 5,442,011 (Halling)

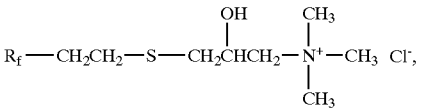

where $R_f$ is $CF_3CF_2(CF_2CF_2)_z$ and z is 2 to 4.

ZONYL® FSG is an anionic polymeric fluorosurfactant that is available from DuPont (Wilmington, Del.).

ZONYL® FSJ is an anionic fluorosurfactant and is believed to contain a hydrocarbon surfactant and a compound having the formula $(R_fCH_2CH_2O)_xPO(O^-NH_4^+)_y$, wherein x+y is 3 and $R_f$ is $R_f$ is $CF_3CF_2(CF_2CF_2)_z$ where z is 2 to 4. It is available from DuPont, (Wilmington, Del.).

ZONYL® FSK is an amphoteric fluorosurfactant and is believed to have the formula $R_f$—$CH_2CHO(Ac)CH_2N^+(CH_3)_2\ CH_2\ COO^-$ wherein $R_f$ is $CF_3CF_2(CF_2CF_2)_z$ and z is 2 to 4. It is available from DuPont (Wilmington, Del.).

ZONYL® FSN-100 is a non-ionic fluorosurfactant and is believed to have the formula $R_fCH_2CH_2O(CH_2CH_2O)_yH$ wherein $R_f$ is $CF_3CF_2(CF_2CF_2)_z$ where z is 2 to 4. It is available from DuPont (Wilmington, Del.).

ZONYL® FSO is a nonionic fluorosurfactant and is believed to have the formula $R_fCH_2CH_2O(CH_2CH_2O)_xH$, wherein x is 0 to 15 and $R_f$ is $CF_3CF_2(CF_2CF_2)_z$ wherein z is 2 to 4. It is available from DuPont (Wilmington, Del.).

ZONYL® FSP is an anionic fluorosurfactant and is believed to have the formula $(R_fCH_2CH_2O)_xPO(O^-NH_4+)_y$ wherein x+y is 3 and $R_f$ is $CF_3CF_2(CF_2CF_2)_z$ wherein z is 2 to 4. It is available from DuPont (Wilmington, Del.).

ZONYL® FS-62 is an anionic fluorosurfactant and is believed to be a mixture of compounds having the formula $C_6F_{13}CH_2CH_2SO_3H$ and $C_6F_{13}CH_2CH_2SO_3^-NH_4^+$. It is available from DuPont, (Wilmington, Del.).

ZONYL® TLF 9515 is an anionic fluorinated phosphate salt. It is available from DuPont (Wilmington, Del.).

ZONYL® TLF 9517 is an anionic fluorinated phosphate salt. It is available from DuPont (Wilmington, Del.).

ZONYL® TLF 9520 is an amphoteric flourosurfactant and is believed to have the formula

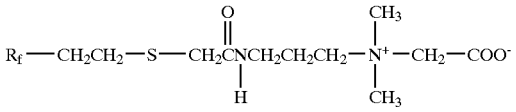

wherein $R_f$ is $CF_3CF_2(CF_2CF_2)_z$ and z is 2 to 4. It is available from DuPont (Wilmington, Del.).

ZONYL® UR is an anionic fluorosurfactant and is believed to have the formula $(R_fCH_2CH_2O)_xPO(OH)_y$, wherein x+y is 3 and $R_f$ is $CF_3CF_2(CF_2CF_2)_z$ wherein z is 2 to 4. It is available from DuPont (Wilmington, Del.).

ZONYL® 8740 is a cationic water-dilutable perfluoroalkyl-methacrylic copolymer in water (70%). It is available from DuPont (Wilmington, Del.).

Resistivity Measurements

Resistivity of antistatic coatings was measured using two different methods, the "decay time" test and the "surface resistivity" test.

In the decay "time test," an ETS Model 406D Static Decay Meter (Electro-Tech Systems Inc., Glenside, Pa.) was used to determine the rate of static charge decay on a sample. The sample is subjected to a fixed voltage to induce an electrostatic charge on its surface. The charge is then dissipated (bled off) by providing a path for current flow to ground. The time for the charge to dissipate to certain pre-selected levels (10% in our test) is recorded.

Decay times were measured in a room maintained at 70° F. (21.1° C.)/20% relative humidity (RH) unless otherwise specified. All testing was done in this room after samples had been acclimated for 18 hours. A +5 kV charge was applied and the time to reach 10% of the charge (90% decay) was recorded. Samples that demonstrate poor antistatic properties do not dissipate charge and their decay times are reported as "not conductive." In order to function as an antistatic material, a compound should provide a coating having a decay time of less than 25 seconds and preferably less than 5 seconds at a temperature of 70° F. (21.1° C.) and a relative humidity of 20%.

In the "surface resistivity" test, three Keithley instruments, a Model 247 High Voltage Supply, a Model 480 Digital Picometer, and a Model 6105 Resistivity Adapter (Keithley Instruments Inc., Cleveland Ohio) were used.

Surface resistivity was again measured in a room maintained at 70° F. (21.1° C.)/20% relative humidity (RH) and all testing was done in this room. A potential of 500 volts was applied to the sample and the current going through the sample was measured. The conversion from amperes (conductivity) to ohm/sq (resistivity) was calculated using the following equation (provided by Kiethley):

$$\text{Ohm/sq}=26{,}700/\text{amperes}$$

The Kiethley Device cannot measure current below $1\times10^{-12}$ amperes. Thus resistivity greater than $2.67\times10^{16}$ ohm/sq cannot be calculated. Films having a resistivity calculated greater than $2.67\times10^{16}$ ohm/sq are reported below as $>2.67\times10^{16}$ ohm/sq. In order to function as an antistatic material, a compound should provide a coating having a resistivity of less than $10^{14}$ ohm/sq, preferably less than $10^{12}$ ohm/sq, and more preferably less than $10^{11}$ ohm/sq at a temperature of 70° F. (21.1° C.) and a relative humidity of 20%.

Experiment 1—Evaluation of Antistatic Formulations

Antistatic Formulation I

Experimental samples for evaluation as antistatic coatings useful on the backside of thermally developable materials were prepared by mixing the following components with stirring:

| | |
|---|---|
| MEK | 88 g |
| CAB 381-20 | 10.98 g |
| Syloid 74X6000 | 0.14 g |
| Antistatic Candidate Compound | amount indicated below |

In preparing the coating formulation, it was preferred to first dissolve the resin in the indicated solvent, followed by dispersing the Syloid 74X6000 matting agent, and finally, adding the indicated amount of antistatic agent to be tested.

The resulting solutions were knife coated onto a sheet of blue tinted poly(ethylene terephthalate) film at a coating gap of 3 mil (76 μm). The coatings were dried at 95° C. for 3.5 minutes to afford antistatic coatings having a dry coating weight of 4.30 g/m$^2$.

The data, shown below in TABLE I, demonstrate that coatings having excellent antistatic properties can be prepared using the fluorochemicals within the scope of the present invention (Experiments 1-1 to 1-8).

Experiments C-1-9 to C-1-15 contained L-9342 (identified above). It is a fluorochemical that is outside the scope of the present invention. Experiments C-1-16 to C-1-110 include other compounds that are believed to be outside the scope of the present invention. These experiments did not perform as well as Experiments 1-1 to 1-8.

TABLE I

| Experiment | Antistatic Agent | Amount of Antistatic Agent (g/100 g of Topcoat) | Decay Time (Seconds) | Keithley SER Resitivity (Ohms/sq) |
|---|---|---|---|---|
| 1-1 | ZONYL ® FSD | 0.87 | 0.01 | $3\times10^9$ |
| 1-2 | ZONYL ® FSD | 1.74 | 0.01 | $2\times10^9$ |
| 1-3 | ZONYL ® FSD | 3.48 | 0.01 | $1\times10^8$ |
| 1-4 | LODYNE ® S106A | 0.261 | 22 | $4.6\times10^{14}$ |
| 1-5 | LODYNE ® S106A | 0.348 | 3.8 | $8.9\times10^{11}$ |
| 1-6 | LODYNE ® S106A | 0.435 | 0.09 | $2.6\times10^{10}$ |

TABLE I-continued

| Experiment | Antistatic Agent | Amount of Antistatic Agent (g/100 g of Topcoat) | Decay Time (Seconds) | Keithley SER Resitivity (Ohms/sq) |
|---|---|---|---|---|
| 1-7 | LODYNE ® S106A | 0.58 | 0.03 | $4 \times 10^{10}$ |
| 1-8 | LODYNE ® S106A | 0.696 | 0.02 | $4 \times 10^{10}$ |
| C-1-9 | L-9342 | 0.435 | not conductive | $1.3 \times 10^{14}$ |
| C-1-10 | L-9342 | 0.87 | 1.06 | $6.7 \times 10^{12}$ |
| C-1-11 | L-9342 | 1.74 | 0.52 | $1.2 \times 10^{12}$ |
| C-1-12 | L-9342 | 2.61 | 0.68 | $6.2 \times 10^{11}$ |
| C-1-13 | L-9342 | 3.48 | 0.24 | $4.2 \times 10^{11}$ |
| C-1-14 | L-9342 | 3.48 | 0.01 | |
| C-1-15 | L-9342 | 8.7 | 0.01 | |
| C-1-16 | ASA-11 | 0.87 | not conductive | |
| C-1-17 | ASA-11 | 1.74 | not conductive | |
| C-1-18 | ASA-11 | 3.48 | 10.97 | |
| C-1-19 | ASA-12 | 0.87 | not conductive | |
| C-1-20 | ASA-12 | 1.74 | not conductive | |
| C-1-21 | ASA-12 | 3.48 | 16.36 | |
| C-1-22 | ASA-13 | 0.87 | not conductive | |
| C-1-23 | ASA-13 | 1.74 | not conductive | |
| C-1-24 | ASA-13 | 3.48 | 3.85 | |
| C-1-25 | AVITEX DN100 | 0.87 | not conductive | |
| C-1-26 | AVITEX DN100 | 1.74 | not conductive | |
| C-1-27 | AVITEX DN100 | 3.48 | 7 | $1 \times 10^{13}$ |
| C-1-28 | AVITEX DN100 | 8.7 | 0.01 | $5 \times 10^{9}$ |
| C-1-29 | DUPONT BA | 1.74 | 40 | $2.7 \times 10^{13}$ |
| C-1-30 | FLOUROLINK XPH613 | 0.87 | not conductive | |
| C-1-31 | FLOUROLINK XPH613 | 1.74 | not conductive | |
| C-1-32 | FLOUROLINK XPH613 | 3.48 | not conductive | |
| C-1-33 | FLOUROLINK XPH614 | 0.87 | not conductive | |
| C-1-34 | FLOUROLINK XPH614 | 1.74 | not conductive | |
| C-1-35 | FLOUROLINK XPH614 | 3.48 | not conductive | |
| C-1-36 | FLOUROLINK XPH615 | 0.87 | not conductive | |
| C-1-37 | FLOUROLINK XPH615 | 1.74 | not conductive | |
| C-1-38 | FLOUROLINK XPH615 | 3.48 | not conductive | |
| C-1-39 | FLOUROLINK XPH616 | 0.87 | not conductive | |
| C-1-40 | FLOUROLINK PH616 | 1.74 | not conductive | |
| C-1-41 | FLOUROLINK XPH616 | 3.48 | not conductive | |
| C-1-42 | FLOWET NMQ | 0.87 | 19.88 | $4 \times 10^{14(a)}$ |
| C-1-43 | FLOWET NMQ | 1.74 | 0.81 | $9 \times 10^{11(a)}$ |
| C-1-44 | FLOWET NMQ | 3.48 | 0.23 | $4 \times 10^{11(a)}$ |
| C-1-45 | SURFONIC ® PE-BP2 | 0.87 | not conductive | |
| C-1-46 | SURFONIC ® PE-BP2 | 1.74 | not conductive | |
| C-1-47 | LODYNE ® S100 | 26.1 | not conductive | |
| C-1-48 | LODYNE ® S100 | 52.2 | not conductive | |
| C-1-49 | LODYNE ® S103A | 26.1 | not conductive | |
| C-1-50 | LODYNE ® S103A | 52.2 | not conductive | |
| C-1-51 | MODIPER ® F600 | 0.87 | not conductive | |
| C-1-52 | MODIPER ® F600 | 1.74 | not conductive | |
| C-1-53 | MODIPER ® F600 | 3.48 | not conductive | |
| C-1-54 | MODIPER ® F600 | 8.7 | not conductive | |
| C-1-55 | MODIPER ® F600 | 1.74 | not conductive | |
| C-1-56 | MODIPER ® F600 | 3.48 | not conductive | |
| C-1-57 | MODIPER ® F600 | 8.7 | not conductive | |
| C-1-58 | MODIPER ® FS700 | 0.87 | not conductive | |
| C-1-59 | POLYFOX | 0.87 | not conductive | |
| C-1-60 | POLYFOX | 1.74 | not conductive | |
| C-1-61 | POLYFOX | 3.48 | not conductive | |
| C-1-62 | SURFLON ® S393 | 0.87 | not conductive | |
| C-1-63 | SURFLON ® S393 | 3.48 | not conductive | |
| C-1-64 | SURFLON ® S393 | 8.7 | not conductive | |
| C-1-65 | SURFLON ® S393 | 21.75 | 22.45 | |
| C-1-66 | SURFLON ® S8405 | 0.87 | not conductive | |
| C-1-67 | SURFLON ® S8405 | 3.48 | not conductive | |

TABLE I-continued

| Experiment | Antistatic Agent | Amount of Antistatic Agent (g/100 g of Topcoat) | Decay Time (Seconds) | Keithley SER Resitivity (Ohms/sq) |
|---|---|---|---|---|
| C-1-68 | SURFLON ® S8405 | 8.7 | not conductive | |
| C-1-69 | SURFLON ® S8405 | 43.5 | 60 | |
| C-1-70 | ZONYL ® 8740 | 0.87 | not conductive | |
| C-1-71 | ZONYL ® 8740 | 8.7 | not conductive | |
| C-1-72 | ZONYL ® 8740 | 87.0 | not conductive | |
| C-1-73 | ZONYL ® FS-62 | 1.74 | not conductive | |
| C-1-74 | ZONYL ® FS-62 | 3.48 | 59 | |
| C-1-75 | ZONYL ® FS-62 | 8.7 | 0.01 | |
| C-1-76 | ZONYL ® FS-62 | 17.4 | 0.01 | |
| C-1-77 | ZONYL ® FSA | 0.87 | not conductive | |
| C-1-78 | ZONYL ® FSA | 8.7 | not conductive | |
| C-1-79 | ZONYL ® FSA | 87.0 | not conductive | |
| C-1-80 | ZONYL ® FSG | 0.87 | not conductive | |
| C-1-81 | ZONYL ® FSG | 3.48 | not conductive | |
| C-1-82 | ZONYL ® FSG | 8.7 | not conductive | |
| C-1-83 | ZONYL ® FSJ | 0.87 | 43.6 | |
| C-1-84 | ZONYL ® FSJ | 1.74 | 5.08 | |
| C-1-85 | ZONYL ® FSJ | 1.74 | 4.92 | |
| C-1-86 | ZONYL ® FSJ | 3.48 | 1.06 | |
| C-1-87 | ZONYL ® FSJ | 8.7 | 0.25 | |
| C-1-88 | ZONYL ® FSJ | 17.4 | 0.02 | |
| C-1-89 | ZONYL ® FSK | 0.87 | not conductive | |
| C-1-90 | ZONYL ® FSK | 1.74 | 41 | |
| C-1-91 | ZONYL ® FSK | 3.48 | 8.1 | |
| C-1-92 | ZONYL ® FSK | 8.7 | 3.4 | |
| C-1-93 | ZONYL ® FSK | 17.4 | 0.71 | |
| C-1-94 | ZONYL ® FSN100 | 0.87 | not conductive | |
| C-1-95 | ZONYL ® FSN100 | 1.74 | not conductive | |
| C-1-96 | ZONYL ® FSN100 | 3.48 | not conductive | |
| C-1-97 | ZONYL ® FSO | 0.87 | not conductive | |
| C-1-98 | ZONYL ® FSO | 8.7 | 2.65 | |
| C-1-99 | ZONYL ® FSO | 17.4 | 0.05 | |
| C-1-100 | ZONYL ® FSO | 3.48 | not conductive | |
| C-1-101 | ZONYL ® FSP | 0.87 | not conductive | |
| C-1-102 | ZONYL ® FSP | 8.7 | not conductive | |
| C-1-103 | ZONYL ® TLF 9515 | 0.87 | 48 | $9 \times 10^{14}$ |
| C-1-104 | ZONYL ® TLF 9515 | 3.48 | 36 | $1 \times 10^{13}$ |
| C-1-105 | ZONYL ® TLF 9517 | 0.87 | 27 | $1 \times 10^{13}$ |
| C-1-106 | ZONYL ® TLF 9517 | 3.48 | 1.14 | $1.5 \times 10^{12}$ |
| C-1-107 | ZONYL ® TLF 9520 | 0.87 | | $1.3 \times 10^{16}$ |
| C-1-108 | ZONYL ® UR | 0.87 | 4.92 | $6 \times 10^{12}$ |
| C-1-109 | ZONYL ® UR | 1.74 | 2 | $3 \times 10^{12}$ |
| C-1-110 | ZONYL ® UR | 3.48 | 0.61 | $1 \times 10^{12}$ |

[a]Experimental samples containing Flowet NMQ displayed severe surface smearing and developed a greasy soap-like deposit on their surface making them unusable in a thermally developable construction.

Experiment 2—Evaluation of Antistatic Formulations

Antistatic Formulation II

Experimental samples containing preferred fluorochemical ZONYL® FSD were prepared for evaluation in antistatic coatings. Antistatic formulations were prepared in-situ by mixing the following components with stirring:

| | |
|---|---|
| MEK | 61.6 g |
| Methanol | 26.4 g |
| CAB 381-20 | 10.98 g |
| Syloid 74X6000 | 0.14 g |
| Active Antistatic Material | amount indicated below. |

In preparing the coating formulations, it was preferred to first dissolve the resin in the indicated solvents, followed by dispersing the Syloid 74X000 matting agent, and finally, adding the indicated amount of antistatic agent to be tested.

The resulting solutions were knife coated onto a sheet of blue tinted poly(ethylene terephthalate) film using a coating gap of 3 mil (76 $\mu$m). The coatings were dried at 95° C. for 3.5 minutes to afford antistatic coatings having a dry coating weight of 4.30 g/m$^2$. Coatings with lower and higher coating weights produced coatings having similar antistatic properties.

The data, shown below in TABLE II, demonstrate that coatings containing fluorochemicals within the scope of the present invention (Experiments 2-6 to 2-14) have acceptable decay time at all coating weights. Experiment 2-6 represents a preferred formulation.

TABLE II

| Experiment | Antistatic Agent | Amount of Antistatic Agent (g/100 g of Topcoat) | Decay Time (Seconds) | Keithley SER Resistivity (Ohms/sq) |
|---|---|---|---|---|
| 2-1 | ZONYL ® FSD | 0.043 | not conductive | $>1 \times 10^{16}$ |
| 2-2 | ZONYL ® FSD | 0.087 | not conductive | $>1 \times 10^{16}$ |
| 2-3 | ZONYL ® FSD | 0.13 | not conductive | $>1 \times 10^{16}$ |

TABLE II-continued

| Experiment | Antistatic Agent | Amount of Antistatic Agent (g/100 g of Topcoat) | Decay Time (Seconds) | Keithley SER Resistivity (Ohms/sq) |
|---|---|---|---|---|
| 2-4 | ZONYL ® FSD | 0.174 | 0.57 | $3 \times 10^{14}$ |
| 2-5 | ZONYL ® FSD | 0.261 | 0.18 | $1 \times 10^{11}$ |
| 2-6 | ZONYL ® FSD | 0.348 | 0.07 | $4 \times 10^{10}$ |
| 2-7 | ZONYL ® FSD | 0.435 | 0.03 | $4 \times 10^{10}$ |
| 2-8 | ZONYL ® FSD | 0.522 | 0.06 | $4 \times 10^{10}$ |
| 2-9 | ZONYL ® FSD | 0.87 | 0.01 | $5 \times 10^{9}$ |
| 2-10 | LODYNE ® 106A | 0.261 | 0.03 | $7.6 \times 10^{10}$ |
| 2-11 | LODYNE ® 106A | 0.348 | 0.03 | $4.4 \times 10^{10}$ |
| 2-12 | LODYNE ® 106A | 0.435 | 0.03 | $2.4 \times 10^{10}$ |
| 2-13 | LODYNE ® 106A | 0.522 | 0.02 | $2.0 \times 10^{10}$ |
| 2-14 | LODYNE ® 106A | 0.609 | 0.01 | $1.6 \times 10^{10}$ |

Experiment 3—Evaluation of Dye Stability

Antistatic formulations were prepared as described above. Antihalation Backcoat dye BC-1 (0.06 g) was added to the formulations. An experimental sample containing only solvent, resin, and antihalation Backcoat dye BC-1 was also evaluated as Control A. A formulation containing L-9342 fluorochemical (outside the scope of the present invention) was also evaluated as Control B.

The formulations were kept covered in the dark at room temperature and their absorbance at 800 nm was measured after 1 day, 2 days, and 7 days.

The results, shown below in TABLE III, demonstrate that incorporation of fluorochemicals within the scope of this invention into backside antihalation layers results in improved resistance to fading of the antihalation dyes. It should be noted that the amount of each fluorochemical in the formulations was not equal by weight. The amount was determined by choosing the lowest concentration of fluorochemical necessary to achieve acceptable conductivity. Thus, the amount of ZONYL® FSD was 60% lower than that of L-9342.

TABLE III

| Experiment | Antistatic Formulation | Antistatic Agent | Amount of Antistatic Agent (g/100 g of Topcoat) | % Fade 1 Day | % Fade 2 Days | % Fade 7 Day |
|---|---|---|---|---|---|---|
| 3-1 | I | ZONYL ® FSD | 0.405 | 6.29 | 10.18 | 25.1 |
| Control A | I | None | 0 | 2.58 | 5.48 | 14.87 |
| Control B | I | L-9342 | 0.87 | 41.18 | 71.7 | 98.5 |
| 3-2 | II | ZONYL ® FSD | 0.405 | 4.46 | 10.43 | 30.6 |
| Control A | II | None | 0 | 2.58 | 1.32 | 8.5 |
| Control B | II | L-9342 | 0.87 | 23.8 | 40.48 | 79.8 |

Example 1

Photothermographic Materials with Improved Aging Characteristics

When a thermally developable material is stored before use, it should remain static free. Because it is not uncommon for a thermally developed film to be looked at even seven years after imaging it should remain static free even after prolonged storage.

Photothermographic materials of the present invention were prepared using the antistatic formulations prepared as described above in a backside conductive layer. The ZONYL® FSD formulation used was that identified above used in preparing Experiment 2-6. The formulation used in preparing Experiment C-1-10 (above) containing L-9342 was also coated to provide a comparison photothermographic material.

Photothermographic emulsion and topcoat formulations were prepared as follows:

Photothermographic Emulsion Formulation

A photothermographic emulsion coating formulation was prepared using a silver salt homogenate prepared substantially as described in Col. 25 of U.S. Pat. No. 5,434,043 (noted above), incorporated herein by reference. The emulsion formulation was then prepared substantially as described in Cols. 19–24 of U.S. Pat. No. 5,541,054 (Miller et al), also incorporated herein by reference.

Topcoat Formulation

A topcoat formulation was prepared for application over the photothermographic emulsion formulation with the following components:

| | |
|---|---|
| MEK | 86.10 weight % |
| Vinyl sulfone | 0.35 weight % |
| Benzotriazole | 0.27 weight % |
| Silica | 0.21 weight % |
| ACRYLOID ® A-21 | 0.47 weight % |
| CAB 171-15S | 12.25 weight % |
| Antihalation dye* | 0.21 weight % |
| Ethyl-2-cyano-3-oxobutanoate | 0.23 weight % |

*This compound is 1,3-bis[2,3-dihydro-2,2-bis[[(1-oxohexyl)-oxy]methyl]-1H-perimidin-6-yl]-2,4-dihydroxy-, bis (inner salt).

The photothermographic emulsion and topcoat formulations were coated onto the side of a 7 mil (178 $\mu$m) blue tinted poly(ethylene terephthalate) film opposite to that containing the antistatic coating.

Coatings were made on a precision multilayer coater equipped with an in-line dryer. The materials were coated, dried, cut into 14×17 inch (35.6 cm×43.2 cm) sheets, stacked, and aged under the conditions described below in TABLES IV and TABLE V.

The evaluation of conductive properties of the antistatic coatings after storage at 700° F. 21.1 at various % relative humidity (RH) has been found to be predictive of how well an antistatic coating will retain its antistatic properties during storage. This is often referred to as "natural shelf keeping." The materials prepared as described above were stored for various times at various humidity conditions. Their surface resistivity was then measured and decay times were measured. The results, shown below in TABLES IV and V, demonstrate that the photothermographic materials of this invention (Examples 1-1 to 1-4) do not lose their antistatic properties over time. The results also demonstrate that the materials of this invention have improved antistatic properties when compared to a comparative photothermographic material containing L-9342 (Examples C-1-5 to C-1-8).

TABLE IV

| Example | Antistatic Agent | Days of Keeping | Keithley SER Resistivity (Ohms/sq) 70° F. (52.2° C.) 20% RH | 70° F. (21.2° C.) 50% RH | 70° F. (52.2° C.) 80% RH |
|---|---|---|---|---|---|
| 1-1 | ZONYL ® FSD | 0 | $4.70 \times 10^{10}$ | $5.05 \times 10^{9}$ | $1.82 \times 10^{9}$ |
| 1-2 | ZONYL ® FSD | 9 | $5.15 \times 10^{10}$ | $5.05 \times 10^{9}$ | $2.2 \times 10^{9}$ |
| 1-3 | ZONYL ® FSD | 65 | $3.83 \times 10^{10}$ | $5.75 \times 10^{9}$ | $1.9 \times 10^{9}$ |
| 1-4 | ZONYL ® FSD | 160 | $3.23 \times 10^{10}$ | $5.75 \times 10^{9}$ | $1.82 \times 10^{9}$ |
| C-1-5 | L-9342 | 0 | $5.62 \times 10^{12}$ | $6.94 \times 10^{11}$ | $1.49 \times 10^{11}$ |
| C-1-6 | L-9342 | 9 | $8.02 \times 10^{12}$ | $2.49 \times 10^{12}$ | $3.77 \times 10^{11}$ |
| C-1-7 | L-9342 | 65 | $1.02 \times 10^{13}$ | $2.5 \times 10^{12}$ | $8.86 \times 10^{11}$ |
| C-1-8 | L-9342 | 160 | $2.39 \times 10^{13}$ | $8.42 \times 10^{12}$ | $2.96 \times 10^{12}$ |

TABLE V

| Example | Antistatic Agent | Days of Keeping | Decay Times (seconds) 70° F. (52.2° C.) 20% RH | 70° F. (21.2° C.) 50% RH | 70° F. (52.2° C.) 80% RH |
|---|---|---|---|---|---|
| 1-1 | ZONYL ® FSD | 0 | 0.03 | — | — |
| 1-2 | ZONYL ® FSD | 9 | 0.03 | .01 | .01 |
| 1-3 | ZONYL ® FSD | 65 | 0.02 | .01 | .01 |
| 1-4 | ZONYL ® FSD | 160 | 0.02 | .01 | .01 |
| C-1-5 | L-9342 | 0 | 2.76 | — | — |
| C-1-6 | L-9342 | 9 | 3.53 | .06 | .011 |
| C-1-7 | L-9342 | 65 | 5.13 | 1.90 | 0.25 |
| C-1-8 | L-9342 | 160 | 9.15 | 7.81 | 1.76 |

Example 2

Photothermographic Materials and Aging Characteristics

Evaluation of antistatic coatings after storage for 7 days at 120° F. (48.8° C.) and 50% RH has been found to be predictive of how well an antistatic coating will retain its antistatic properties over a long period of time, both before and after imaging.

Photothermographic materials of the present invention were prepared as described in Example 1 above using antistatic Formulations II as described above as backside conductive layers. The materials of the present invention comprised a backside conductive layer prepared using the formulation of Experiment 2-6 (above). Another photothermographic material comprising a backside conductive layer containing L-9342 was prepared using the formulation used of Experiment C-1-12 (above). This material served as a comparison. Coatings were made on a precision multilayer coater equipped with an in-line dryer. The materials were coated, dried, cut into 14×17 inch (35.6 cm×43.2 cm) sheets, and stacked.

The photothermographic materials were then stored at 120° F. (48.8° C.) and 50% RH. Their surface resistivity and decay times were measured after 4, 8, and 14 days. The results, shown below in TABLE VI, demonstrate that the photothermographic materials of the present invention (Examples 2-1 to 2-4) had acceptable surface resistivity after accelerated aging. Comparative Examples C-2-5 to C-2-8 containing L-9342 did not perform as well.

TABLE VI

| Example | Antistatic Agent | Days of Keeping | Decay Time (Seconds) | Keithley SER Resistivity (Ohms/sq) |
|---|---|---|---|---|
| 2-1 | ZONYL ® FSD | 0 day | 0.03 | $1 \times 10^{11}$ |
| 2-2 | ZONYL ® FSD | 4 day | 0.11 | $2 \times 10^{11}$ |
| 2-3 | ZONYL ® FSD | 8 day | 0.12 | $2 \times 10^{11}$ |
| 2-4 | ZONYL ® FSD | 14 day | 0.15 | $2.5 \times 10^{11}$ |
| C-2-5 | L-9342 | 0 day | 3.05 | $8 \times 10^{12}$ |
| C-2-6 | L-9342 | 4 day | 12 | $2 \times 10^{13}$ |
| C-2-7 | L-9342 | 8 day | 32 | $7 \times 10^{13}$ |
| C-2-8 | L-9342 | 14 day | 83 | $1 \times 10^{14}$ |

Example 3

Thermographic Material

Thermographic materials of the present invention were prepared as described above using antistatic Formulation II as a backside conductive layer.

Silver Soap Homogenate Formulation

A silver soap thermographic homogenate formulation was prepared with the following components.

| | |
|---|---|
| MEK | 75.5% |
| Silver Behenate | 24.0% |
| PIOLOFORM ® BL-16 | 0.5% |

The materials were mixed and homogenized by passing twice through a homogenizer at 5000 psi (352 kg/cm$^2$). The materials were cooled between the two passes.

Thermographic Emulsion Formulation

To 24.74 g of this silver behenate homogenate at 24.5% solids was added 2.77 g of MEK, 0.96 g of phthalazinone, 1.71 g of 2,3-dihydroxybenzoic acid, and a solution of 20.9 g of BUTVAR® B-79 in 48.9 g of MEK. The reaction was stirred for 10 minutes to dissolve the materials.

Topcoat Formulation

A topcoat formulation was prepared for application over the thermographic emulsion formulation with the following components:

| | |
|---|---|
| MEK | 44.8 g |
| CAB 171-15S | 51.10 g |
| PARALOID A-21 | 1.36 g |
| DC 550 | 1.65 g |
| SERVOXYL ® VPAZ 100 | 0.22 g |
| ALBACAR 5970 | 0.15 g |

The resulting topcoat solution contained 13.9% solids and had a viscosity of 90 centipoise.

The thermographic emulsion and topcoat formulations were coated onto a 7 mil (178 $\mu$m) blue tinted polyethylene terephthalate support using a conventional dual knife coating machine. Samples were dried in an oven at 200° F. (93.3° C.) for 3.5 minutes. The coating weight of the thermographic emulsion layer was 2.0 g/ft$^2$ (21.5 g/m$^2$). The coating weight of the topcoat layer was 0.4 g/ft$^2$ (4.31 g/m$^2$).

An antistatic layer was prepared incorporating ZONYL® FSD. The formulation used was that identified above for preparing Experiment 2-6. The antistatic layer was knife coated onto the backside of the thermographic material using a coating gap of 3 mil (76 $\mu$m). The coatings were dried at 95° C. for 3.5 minutes to afford antistatic coatings having a dry coating weight of 4.30 g/m$^2$.

The thermographic materials were then stored at 120° F. (48.8° C.) and 50% RH. Their surface resistivity and decay times were measured after 0, 4, 8, and 14 days. The results, shown below in TABLE VII, demonstrate that the unimaged thermographic materials of the present invention (Examples 3-1 to 3-4) had acceptable surface resistivity after accelerated aging for at least 8 days.

TABLE VII

| Example | Antistatic Agent | Days of Keeping | Decay Time (Seconds) | Keithley SER Resistivity (Ohms/sq) |
|---|---|---|---|---|
| 3-1 | ZONYL ® FSD | 0 | 0.03 | $6.6 \times 10^{10}$ |
| 3-2 | ZONYL ® FSD | 4 | 0.06 | $6.8 \times 10^{10}$ |
| 3-3 | ZONYL ® FSD | 8 | 0.07 | $6.4 \times 10^{10}$ |
| 3-4 | ZONYL ® FSD | 14 | 12.03 | $1.91 \times 10^{13}$ |

Samples of the resulting thermographic materials were also imaged using an AGFA DryStar™ Model 2000 printer. A test pattern was used. All samples gave several levels of gray and a black image.

These thermographic materials were also stored at 120° F. (48.8° C.) and 50% RH. Their surface resistivity and decay times were also measured after 0, 4, 8, and 14 days. The results, shown below in TABLE VIII, demonstrate that the imaged thermographic materials of the present invention (Examples 3-5 to 3-8) had acceptable surface resistivity after accelerated aging for at least 14 days.

TABLE VIII

| Example | Antistatic Agent | Days of Keeping | Decay Time (Seconds) | Keithley SER Resistivity (Ohms/sq) |
|---|---|---|---|---|
| 3-5 | ZONYL ® FSD | 0 | 0.03 | $3.3 \times 10^{10}$ |
| 3-6 | ZONYL ® FSD | 4 | 0.07 | $6.4 \times 10^{10}$ |
| 3-7 | ZONYL ® FSD | 8 | 0.09 | $8.6 \times 10^{10}$ |
| 3-8 | ZONYL ® FSD | 14 | 0.54 | $8.9 \times 10^{11}$ |

The invention has been described in detail with particular reference to certain preferred embodiments thereof, but it will be understood that variations and modifications can be effected within the spirit and scope of the invention.

We claim:

1. An organic solvent-based thermally developable material comprising a support and having thereon at least one thermally developable layer coated out of an organic solvent on only one side of said support, and on the opposing backside of said support, a conductive layer that is coated out of an organic solvent and comprising one or more hydrophobic binders and as the sole antistatic agent(s), one or more nonpolymeric fluorochemicals represented by the following Structure I:

$$R_f—R—N(R_1)(R_2)(R_3)^+X^- \quad (I)$$

wherein $R_f$ is a straight or branched chain perfluoroalkyl group having 4 to 18 carbon atoms, R is represented by —$R_a$—S—$R_b$— wherein $R_a$ and $R_b$ are independently substituted or unsubstituted alkylene groups having 2 to 4 carbon atoms in the chain, $R_1$, $R_2$, $R_3$ are independently hydrogen or alkyl groups or any two of $R_1$, $R_2$, and $R_3$ taken together can represent the carbon and nitrogen atoms necessary to provide a 5- to 7-membered heterocyclic ring with the cationic nitrogen atom, and $X^-$ is a monovalent anion, wherein the weight ratio of said nonpolymeric fluorochemical to said one or more hydrophobic binders in said backside conductive layer is from about 0.018:1 to about 0.055:1.

2. The thermally developable material of claim 1 wherein $R_f$ comprises 6 to 12 fully fluorinated carbon atoms.

3. The thermally developable material of claim 1 wherein said nonpolymeric fluorochemical has a molecular weight of from about 500 to about 3000.

4. The thermally developable material of claim 1 wherein $R_1$, $R_2$, and $R_3$ are independently hydrogen or unsubstituted alkyl groups having 2 to 4 carbon atoms.

5. The thermally developable material of claim 1 wherein said nonpolymeric fluorochemical is a compound represented by Structure I-1 below wherein $R_f$ comprises 6 to 12 fully fluorinated carbon atoms:

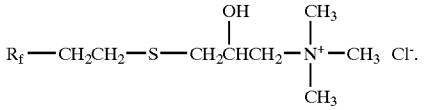

(I-1)

6. The thermally developable material of claim 1 wherein said nonpolymeric fluorochemical is present in an amount sufficient to provide a backside surface resistivity measured at 25° C. and 20% relative humidity of $4\times10^{11}$ ohms or less.

7. The thermally developable material of claim 1 wherein said nonpolymeric fluorochemical is present in an amount of from about 0.011 to about 0.021 g/m$^2$.

8. The thermally developable material of claim 1 wherein at least one of said hydrophobic binders is cellulose acetate butyrate.

9. The thermally developable material of claim 1 wherein said backside conductive layer further comprises an antihalation composition.

10. The thermally developable material of claim 1 further comprising a protective layer disposed over said backside conductive layer.

11. The thermally developable material of claim 1 that is a photothermographic material and further comprises a photosensitive silver halide.

12. An organic solvent-based black-and-white thermographic material that comprises a support having on one side thereof one or more thermally-developable imaging layers coated out of an organic solvent and comprising a binder and in reactive association, a non-photosensitive source of reducible silver ions and a reducing agent composition for said non-photosensitive source of reducible silver ions, and on the opposing backside of said support, a conductive layer that is coated out of an organic solvent and comprising one or more hydrophobic binders and as the sole antistatic agent(s), one or more nonpolymeric fluorochemicals represented by the following Structure I:

$$R_f—R—N(R_1)(R_2)(R_3)^+X^- \quad (I)$$

wherein $R_f$ is a straight or branched chain perfluoroalkyl group having 4 to 18 carbon atoms, R is represented by —$R_a$—S—$R_b$— wherein $R_a$ and $R_b$ are independently substituted or unsubstituted alkylene groups having 2 to 4 carbon atoms in the chain, $R_1$, $R_2$, $R_3$ are independently hydrogen or alkyl groups or any two of $R_1$, $R_2$, and $R_3$ taken together can represent the carbon and nitrogen atoms necessary to provide a 5- to 7-membered heterocyclic ring with the cationic nitrogen atom, and $X^-$ is a monovalent anion, wherein the weight ratio of said nonpolymeric fluorochemical to said one or more hydrophobic binders in said backside conductive layer is from about 0.018:1 to about 0.055:1.

13. A method of forming a visible image comprising thermal imaging of the thermally developable material of claim 12.

14. An organic solvent-based photothermographic material that comprises a support having on one side thereof one or more thermally developable imaging layers coated out of an organic solvent and comprising a hydrophobic binder and in reactive association, a photosensitive silver halide, a non-photosensitive source of reducible silver ions, and a reducing agent composition for said non-photosensitive source reducible silver ions, and on the opposing backside of said support, a conductive layer coated out of an organic solvent and comprising one or more hydrophobic binders and as the sole antistatic agent(s), one or more nonpolymeric fluorochemicals represented by the following Structure I:

$$R_f—R—N(R_1)(R_2)(R_3)^+X^- \quad (I)$$

wherein $R_f$ is a straight or branched chain perfluoroalkyl group having 4 to 18 carbon atoms, R is a divalent linking group comprising at least 4 carbon atoms and a sulfide group in the chain, $R_1$, $R_2$, $R_3$ are independently hydrogen or alkyl groups or any two of $R_1$, $R_2$, and $R_3$ taken together can represent the carbon and nitrogen atoms necessary to provide a 5- to 7-membered heterocyclic ring with the cationic nitrogen atom, and $X^-$ is a monovalent anion, wherein the weight ratio of said nonpolymeric fluorochemical to said one or more hydrophobic binders in said backside conductive layer is from about 0.018:1 to about 0.055:1.

15. The photothermographic material of claim 14 wherein said non-photosensitive source of reducible silver ions is a silver fatty acid carboxylate having 10 to 30 carbon atoms in the fatty acid or a mixture of said silver fatty acid carboxylates, as least one of which is silver behenate.

16. The photothermographic material of claim 14 wherein said support is a transparent polyester film and said backside conductive layer further comprises a cellulose ester binder.

17. The photothermographic material of claim 14 further comprising a protective layer over said one or more thermally developable layers.

18. The photothermographic material of claim 14 that provides a black-and-white image.

19. The photothermographic material of claim 14 wherein $R_f$ comprises 4 to 12 fully fluorinated carbon atoms, and said nonpolymeric fluorochemical has a molecular weight of from about 500 to about 1500.

20. The photothermographic material of claim 14 wherein said nonpolymeric fluorochemical is a compound represented by Structure I-1 below wherein $R_f$ comprises 6 to 12 fully fluorinated carbon atoms:

(I-1)

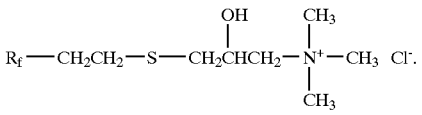

21. The photothermographic material of claim 14 wherein said nonpolymeric fluorochemical is present in an amount sufficient to provide a backside surface resistivity measured at 25° C. and 20% relative humidity of $4\times10^{11}$ ohms or less.

22. The photothermographic material of claim 14 wherein said backside conductive layer further comprises an antihalation composition.

23. The photothermographic material of claim 22 wherein said backside conductive layer comprises a heat-bleachable antihalation composition.

24. A method of forming a visible image comprising:

A) imagewise exposing the photothermographic material of claim 14 to electromagnetic radiation to form a latent image, B) simultaneously or sequentially, heating said exposed photothermographic material to develop said latent image into a visible image.

25. The method of claim 24 wherein said photothermographic material comprises a transparent support, and said image-forming method further comprises:

C) positioning said exposed and heat-developed photothermographic material with the visible image therein between a source of imaging radiation and an imageable material that is sensitive to said imaging radiation, and D) exposing said imageable material to said imaging radiation through the visible image in said exposed and heat-developed photothermographic material to provide an image in said imageable material.

26. The method of claim 24 wherein said photothermographic material is imaged at an exposure wavelength greater than 700 nm.

27. An organic solvent-based black-and-white photothermographic material that comprises a support having thereon:

a) one or more thermally developable imaging layers each coated out of an organic solvent and comprising a hydrophobic binder, and in reactive association, a photosensitive silver bromide or silver iodobromide or a mixture thereof;

a non-photosensitive source of reducible silver ions that includes one or more silver carboxylates at least one of which is silver behenate, a reducing agent composition for said non-photosensitive source reducible silver ions that includes at least one hindered phenol, and at least one toner, antifoggant, spectral sensitizing dye, or high contrast agent, or any combination thereof, b) a protective overcoat coated out of an organic solvent and disposed over said one or more thermally developable imaging layers, c) on the opposing backside of said support, a conductive layer coated out of an organic solvent and comprising one or more hydrophobic binders and an antihalation composition and as the sole antistatic agent(s), one or more compounds represented by Structure I-1 below wherein $R_f$ comprises 6 to 12 fully fluorinated carbon atoms:

(I-1)

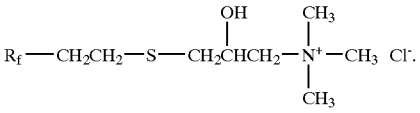

wherein the weight ratio of said nonpolymeric fluorochemical to said one or more hydrophobic binders in said backside conductive layer is from about 0.018:1 to about 0.055:1.

* * * * *